US006933827B2

(12) United States Patent
Takeuchi et al.

(10) Patent No.: US 6,933,827 B2
(45) Date of Patent: Aug. 23, 2005

(54) ACTUATOR, METHOD OF MANUFACTURING THE ACTUATOR AND CIRCUIT BREAKER PROVIDED WITH THE ACTUATOR

(75) Inventors: Toshie Takeuchi, Tokyo (JP); Nobumoto Tohya, Tokyo (JP); Mitsuru Tsukima, Tokyo (JP); Takafumi Nakagawa, Tokyo (JP); Yoshiharu Kobayashi, Hyogo (JP); Hitoshi Gotou, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 102 days.

(21) Appl. No.: 10/671,575

(22) Filed: Sep. 29, 2003

(65) Prior Publication Data

US 2004/0093718 A1 May 20, 2004

(30) Foreign Application Priority Data

Nov. 15, 2002 (JP) ..... 2002-331675

(51) Int. Cl.[7] ..... H01F 27/24
(52) U.S. Cl. ..... 336/212; 335/229
(58) Field of Search ..... 336/83, 212, 214–216, 336/233–234; 335/229–234, 251–264

(56) References Cited

U.S. PATENT DOCUMENTS 3,683,239 A 8/1972 Sturman
3,952,272 A * 4/1976 Howell, Jr. ..... 335/264
4,290,039 A * 9/1981 Tochizawa ..... 335/262
4,533,890 A * 8/1985 Patel ..... 335/234
6,009,615 A 1/2000 McKean et al.
2002/0093408 A1 7/2002 Morita et al.

FOREIGN PATENT DOCUMENTS

| | | | |
|---|---|---|---|
| DE | 43 04 921 | | 8/1994 |
| DE | 4304921 | | 8/1994 |
| EP | 0 354 803 | | 2/1990 |
| EP | 0 580 285 | A2 * | 1/1994 |
| EP | 1 132 929 | A1 * | 9/2001 |
| GB | 2 297 429 | A * | 7/1996 |
| WO | WO 01/65581 | | 9/2001 |

* cited by examiner

*Primary Examiner*—Tuyen T Nguyen
(74) *Attorney, Agent, or Firm*—Leydig, Voit & Mayer, Ltd.

(57) ABSTRACT

In an actuator, coils are kept from being displaced along a y-axis direction as projections of coil bobbins are sandwiched between first and second iron cores along the y-axis direction. Also, the coils are kept from being displaced excessively along x- and z-axis directions due to shocks, for instance, because they are fitted in groovelike channels fitted in the first and second iron cores. Since two bearings are sandwiched and fixed between third and fourth iron cores along the x-axis direction, the bearings can be easily set on a common axis with high accuracy. It is therefore possible to prevent displacement of the coils during operation of the actuator. Slidable support plates ensure smooth movements of an armature and thereby provide improved reliability, even when the distance between the support plates and the first to fourth iron cores is reduced.

17 Claims, 28 Drawing Sheets

"PRIOR ART"

ACTUATOR, METHOD OF MANUFACTURING THE ACTUATOR AND CIRCUIT BREAKER PROVIDED WITH THE ACTUATOR

BACKGROUND OF THE INVENTION

1. Field of the Invention

This invention relates to an actuator, a method of manufacturing the actuator and a circuit breaker employing the actuator.

2. Description of the Background Art

Conventionally, permanent magnet actuators have been used in circuit breakers as disclosed in German Patent Publication No. DE 4304921 C1, for example. FIG. 28 is a diagram showing the construction of a circuit breaker 2 employing conventional actuators 1. Each of these actuators 1 is used to open and close contacts 4 which are arranged face to face with each other in a vacuum valve 3 of the circuit breaker 2, for example, by driving one of the contacts 4 in linear motion. Each actuator 1 includes a generally square-shaped yoke and a parallelepiped-shaped armature accommodated in an inner space of the yoke. The yoke has upper, lower, left-hand and right-hand yoke portions forming four sides of the square shape. Projecting inwards from central parts of the left-hand and right-hand yoke portions are magnetic poles which are situated on opposite sides at a specific distance from each other.

The armature is located between the opposing magnetic poles. On both side of the armature, there are provided plates which are supported movably up and down by bearings. The armature is sandwiched between these plates and screwed thereto. With this arrangement, the armature is supported movably up and down by means of the bearings in the inner space of the yoke. Permanent magnets are affixed to the individual magnetic poles in a manner that narrow gaps are created between the armature and the permanent magnets. The armature is held at a first position where the armature is attracted to the upper yoke portion and at a second position where the armature is attracted to the lower yoke portion by a magnetic force exerted by the permanent magnets.

To move the armature from one bistable position to the other, and vice versa, there is provided a pair of generally square-shaped exciting coils having square-shaped inside surfaces in the inner space of the yoke. As the armature is driven between the first and second bistable positions, it travels not only between the two opposing magnetic poles but also along the square-shaped inside surfaces of the exciting coils. When one of the exciting coils is excited, it produces an electromagnetic driving force which cancels out the magnetic force exerted by the permanent magnets at the first bistable position and attracts the armature to the second bistable position, causing the armature to move thereto.

When the other exciting coil is excited, it produces an electromagnetic driving force which cancels out the magnetic force exerted by the permanent magnets at the second bistable position and attracts the armature to the first bistable position, causing the armature to move thereto. As the armature is driven between the two bistable positions in this fashion, the movable contact in the vacuum valve 3 connected to the armature via the plates moves up and down, thereby opening and closing the contacts 4 in each vacuum valve 3.

In the conventional actuator 1 thus constructed, the armature moves up and down, controlled by currents flowed through the two exciting coils. Although it is desirable that the armature move while maintaining narrow gaps between the armature and the magnetic poles, and between the armature and the inside surfaces of the exciting coils, the armature could occasionally move in sliding contact with the permanent magnets or exciting coils due to manufacturing errors, for instance. In particular, if the armature moves in sliding contact with the permanent magnets, the permanent magnets wear and produce ferromagnetic powder. Should this ferromagnetic powder stay in the narrow gaps, it could prevent smooth movement of the armature, leading to a deterioration in reliability of operation of the actuator 1.

Furthermore, if the exciting coils are not securely fastened to the yoke, the exciting coils might be displaced due to shocks caused by movement of the armature or makebreak action of the vacuum valve 3, preventing smooth movement of the armature. To cause the armature to move up and down while maintaining narrow gaps between the armature and the magnetic poles, and between the armature and the inside surfaces of the exciting coils, it is desirable to support the armature with a pair of bearings provided at both ends of the armature to support it movably up and down. To achieve this, it is necessary to locate two bearings on a common axis along the moving direction of the armature as much as possible.

SUMMARY OF THE INVENTION

To overcome the aforementioned problems of the prior art, the invention has as an object the provision of an actuator for a power supply circuit breaker featuring compactness, low cost and high reliability of operation.

According to the invention, an actuator includes a fixed iron core unit, an armature unit and a coil. The fixed iron core unit includes first to fourth iron cores, the first iron core having a closed core portion and groovelike channels which are formed between the closed core portion and a pair of projecting portions extending inward from opposite sides of the closed core portion along an x-axis direction of a Cartesian coordinate system defined by x-, y- and z-axes of the closed core portion, the second iron core having a closed core portion, and the third and fourth iron cores individually having split core portions.

The closed core portions of the first and second iron cores are placed face to face at a specific distance from each other along the y-axis direction in such a manner that they overlap each other as viewed along the y-axis direction. The third and fourth iron cores are placed face to face with each other along the x-axis direction between the first and second iron cores in such a manner that the split core portions of the third and fourth iron cores together constitute a central closed core portion which overlaps the closed core portions of the first and second iron cores as viewed along the y-axis direction. The closed core portions of the first and second iron cores and the central closed core portion formed by the split core portions of the third and fourth iron cores together form an armature accommodating space surrounded thereby.

The armature unit includes an armature made of a magnetic material and first and second rod members attached to the armature. The coil includes a bobbin and a winding wound around the bobbin, the bobbin having projections extending along the z-axis direction.

The coil is kept from being displaced along the x- and z-axis directions as it is fitted in the groovelike channels formed in the first iron core, and the coil is kept from being displaced along the y-axis direction as the projections of the bobbin are sandwiched between the first and second iron cores from both sides along the y-axis direction. The armature of the armature unit is accommodated in the armature accommodating space and supported movably along the z-axis direction by the first and second rod members which are fitted in bearings provided in the fixed iron core unit.

In this actuator of the invention, the coil is kept from being displaced along the x- and z-axis directions as it is fitted in the groovelike channels formed in the first iron core. Also, the coil is kept from being displaced along the y-axis direction with the projections of the bobbin sandwiched between the first and second iron cores from both sides along the y-axis direction. In this construction, the coil can be easily set in position and securely fixed so that it will not be displaced due to shocks, for instance. Even when the bobbin has shrunk due to aging, it will not move from its original position beyond a specific distance. This makes it possible to reduce the dimensions of inside portions of the bobbin as well as its ampere-turn value and achieve a reduction in its size and weight.

These and other objects, features and advantages of the invention will become more apparent upon reading the following detailed description in conjunction with the accompanying drawings.

DETAILED DESCRIPTION OF THE PREFERRED EMBODIMENTS OF THE INVENTION

First Embodiment

Figure 1B:
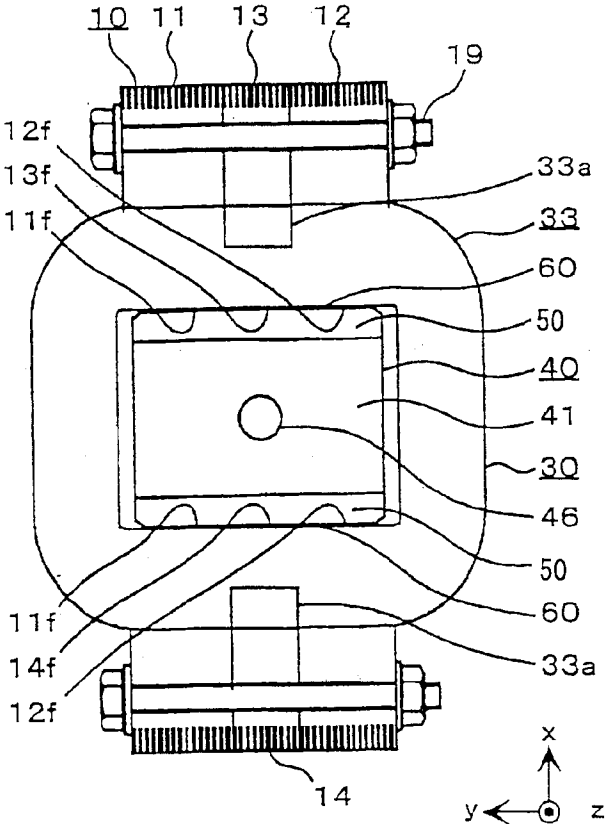
FIGS. 1A and 1B are sectional diagrams showing the construction of an actuator according to a first embodiment of the invention.
Figure 1A:
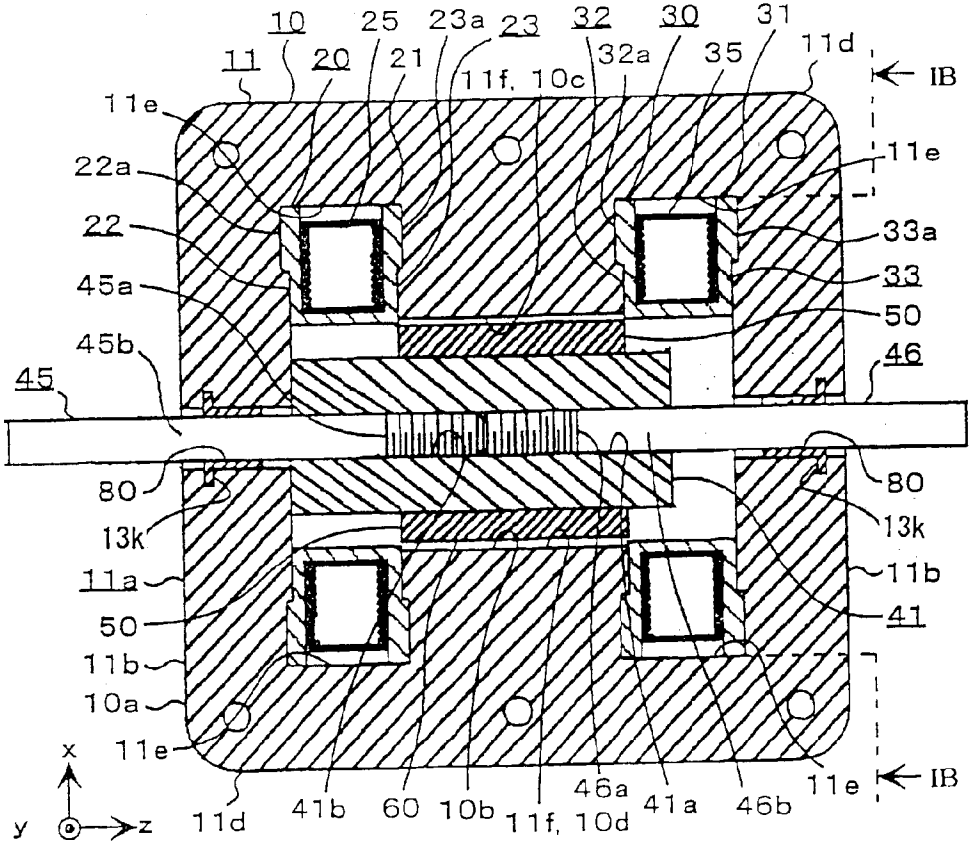
Figure 2B:
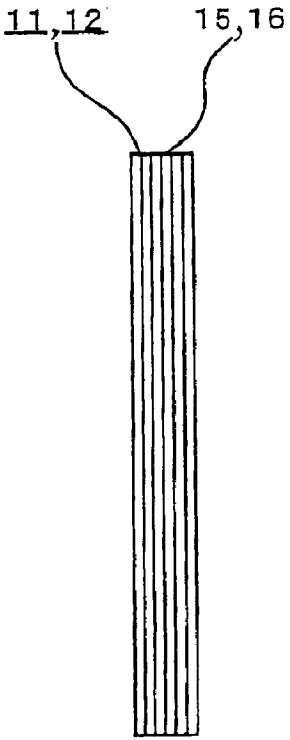
FIGS. 2A and 2B are a front view and a side view of first and second iron cores of FIGS. 1A and 1B.
Figure 2A:
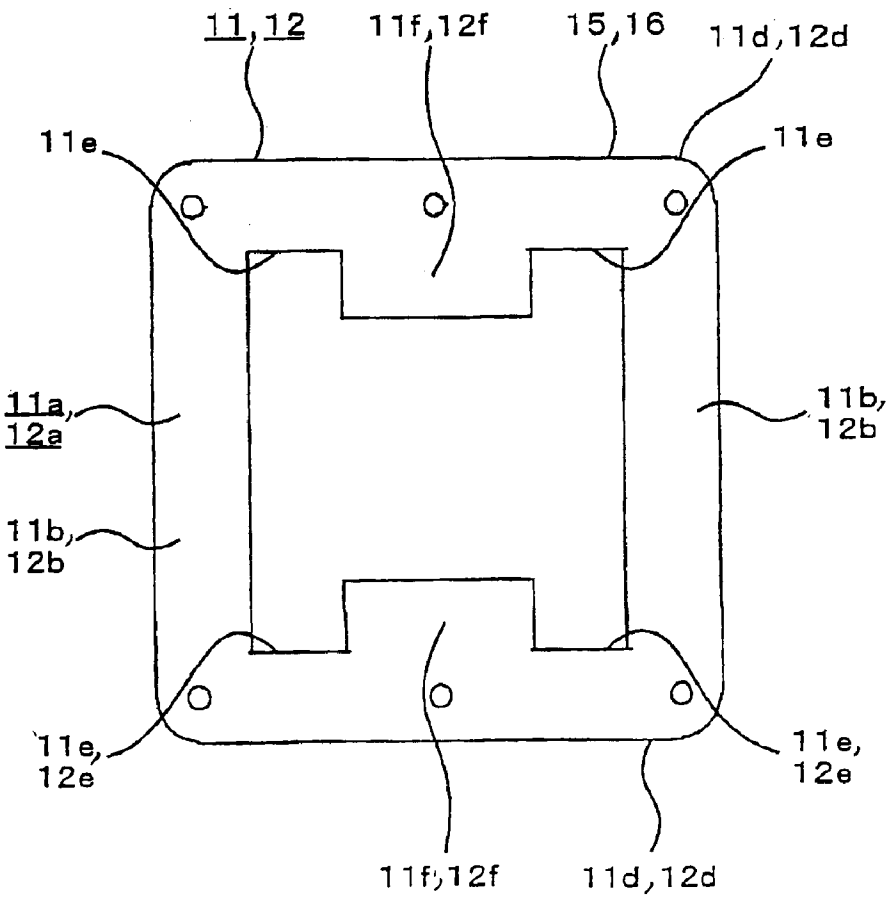
Figure 4C:
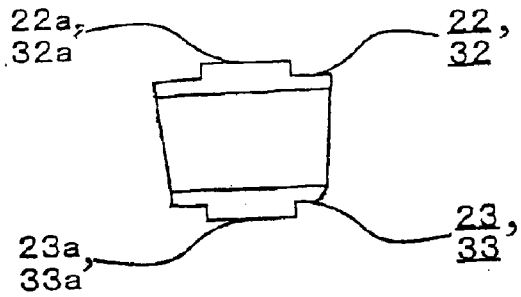
FIGS. 4A, 4B and 4C are a front view, a side view and a fragmentary plan view of a coil bobbin.
Figure 5B:
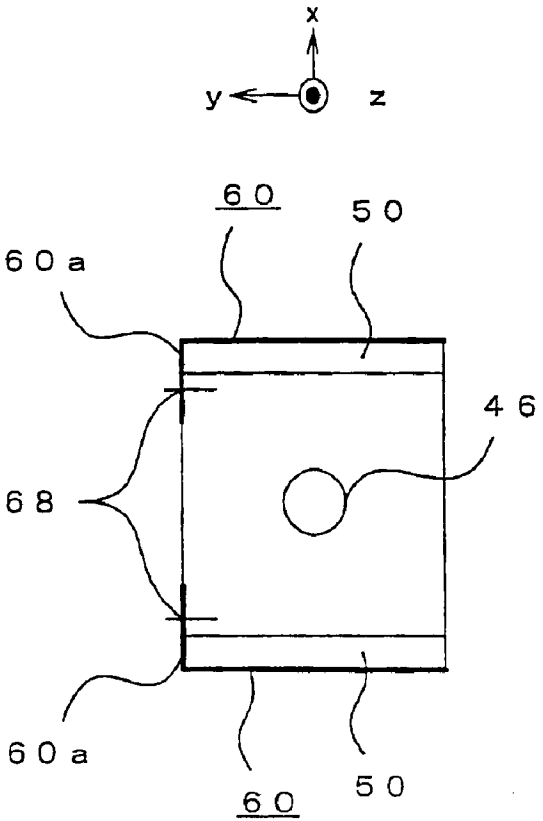
FIGS. 5A and 5B are diagrams showing the construction of an armature fitted with permanent magnets and support plates.
Figure 5A:
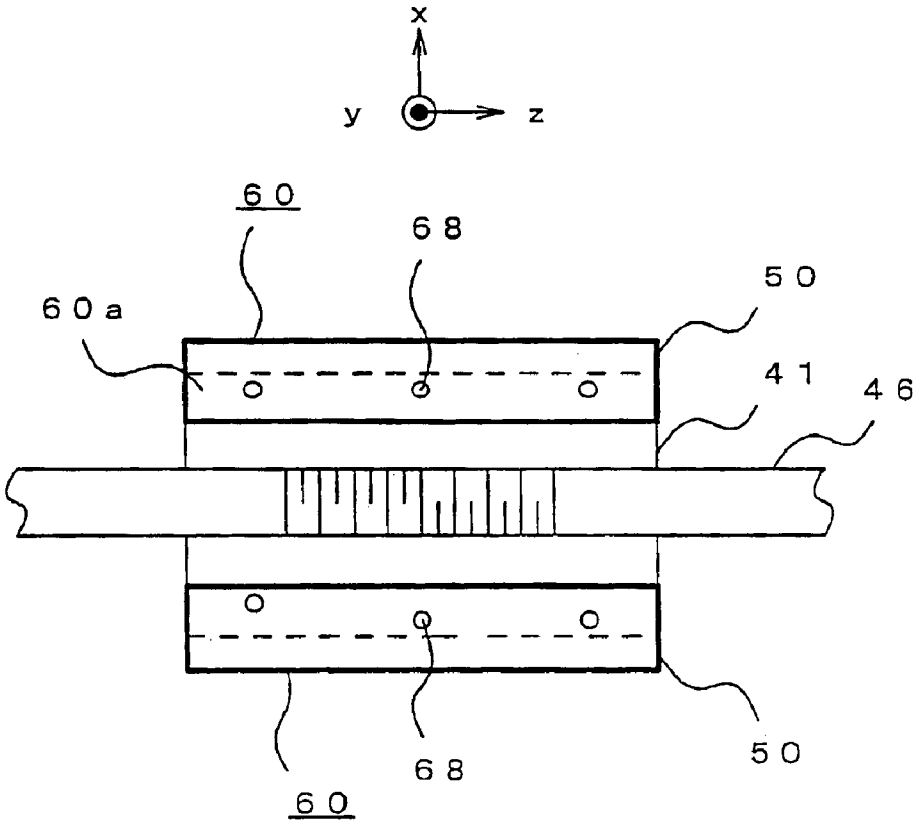
Figure 6A:
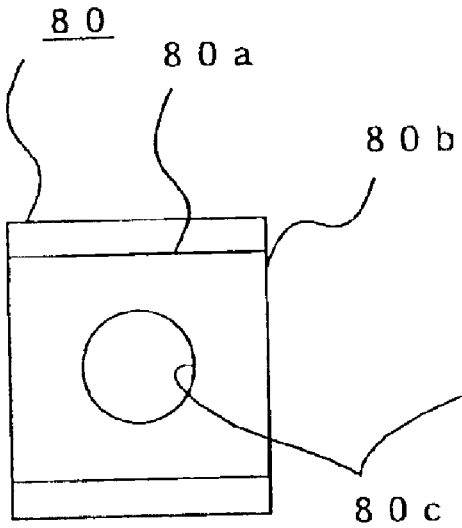
FIGS. 6A and 6B are a front view and a side view of bearings used in the actuator of the first embodiment.

FIGS. 1A, 13, 2A, 23, 3A, 3B, 4A, 4B, 4C, 5A, 5B, 6A, 6B and 7 are diagrams showing an actuator according to a first embodiment of the invention. FIG. 1A is a sectional diagram showing the construction of the actuator, FIG. 1B is a sectional diagram taken along lines IB—IB of FIG. 1A, FIG. 2A is a front view of first and second iron cores 11, 12, FIG. 2B is a side view of the first and second iron cores 11, 12, FIG. 3A is a front view of third and fourth iron cores 13, 14, and FIG. 33 is a side view of the third and fourth iron cores 13, 14. FIG. 4A is a front view of coil bobbins 21, 31, FIG. 43 is a side view of the coil bobbins 21, 31, and FIG. 4C is a fragmentaryplan view of the coil bobbins 21, 31. FIGS. 5A and 53 are diagrams showing the construction of an armature 41 fitted with upper and lower permanent magnets 50 and upper and lower support plates 60, FIGS. 6A and 63 are diagrams showing the construction of bearings 80, and FIG. 7 is a diagram illustrating the working of the actuator.

Figure 28:
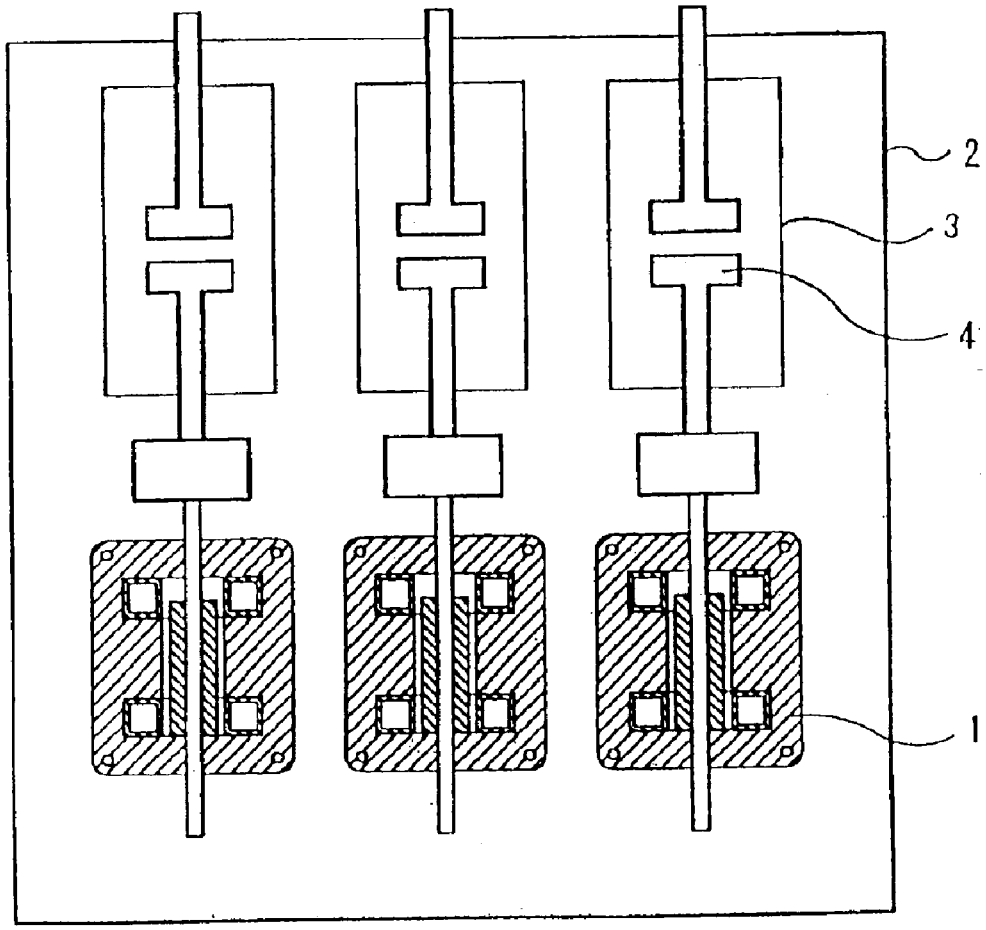
FIG. 28 is a diagram showing the construction of a circuit breaker including actuators and vacuum valves of which contacts are opened and closed by the actuators which are connected to the respective contacts.

A circuit breaker is constructed in the same fashion as illustrated in FIG. 28, including actuators of the invention and vacuum valves of which contacts are opened and closed by the actuators of which later-described support shafts 45 or 46 (rod members) are connected to the respective contacts.

Referring to FIGS. 1A and 1B, a fixed iron core unit 10 includes the aforementioned first to fourth iron cores 11–14. Here, a Cartesian coordinate system defined by x-, y- and z-axes as shown in FIG. 1A is used in the following description of the embodiment, in which the x-axis is taken in the vertical direction, the y-axis in a direction perpendicular to the page of FIG. 1A, and the z-axis in the horizontal (left-right) direction. As shown in FIG. 1B, the first iron core 11 and the second iron core 12 are situated on opposite sides at a specific distance from each other in the y-axis direction. The third iron core 13 and the fourth iron core 14 are placed between the first iron core 11 and the second iron core 12 such that the third iron core 13 and the fourth iron core 14 face each other along the x-axis (vertical) direction with the later-described support shafts 45, 46 located at the middle of the third iron core 13 and the fourth iron core 14.

The first iron core 11 has a generally square-shaped closed core portion 11*a* and a pair of projecting magnetic pole portions 11*f*. The closed core portion 11*a* includes left and right yoke portions 11*b* and upper and lower yoke portions 11*d* which together form a square frame structure. The two projecting magnetic pole portions 11*f* constituting integral parts of the upper and lower yoke portions 11*d* extend inward from the individual yoke portions 11*d* and are located on opposite sides at a specific distance from each other in the x-axis direction of FIG. 1A. The left and right yoke portions 11*b* and the individual projecting magnetic pole portions 11*f* together form groovelike channels 11*e* in which later-described coils 20, 30 are fitted. More specifically, two pairs of groovelike channels 11*e* are located at opposed positions (upper and lower) in the x-axis direction of FIG. 1A, wherein the upper two groovelike channels 11*e* are situated on opposite sides at a specific distance from each other in the z-axis direction as are the lower two groovelike channels 11*e*.

The first iron core 11 is a generally square-shaped sheet metal assembly formed by stacking a specific number of ferromagnetic laminations 15, each produced by punching a thin magnetic steel sheet into a generally square window frame shape (see FIGS. 2A and 2B). The individual ferromagnetic laminations 15 are loosely bonded for ease of handling. Having the same shape as the first iron core 11, the second iron core 12 is also a generally square-shaped sheet metal assembly formed by stacking a specific number of ferromagnetic laminations 16. Like the first iron core 11, the second iron core 12 has a generally square-shaped closed core portion 12*a*, two pairs of groovelike channels 12*e* and a pair of projecting magnetic pole portions 12*f*. The closed core portion 12*a* includes left and right yoke portions 12*b* and upper and lower yoke portions 12*d* which together form a square frame structure (see FIG. 2A).

Figure 3B:
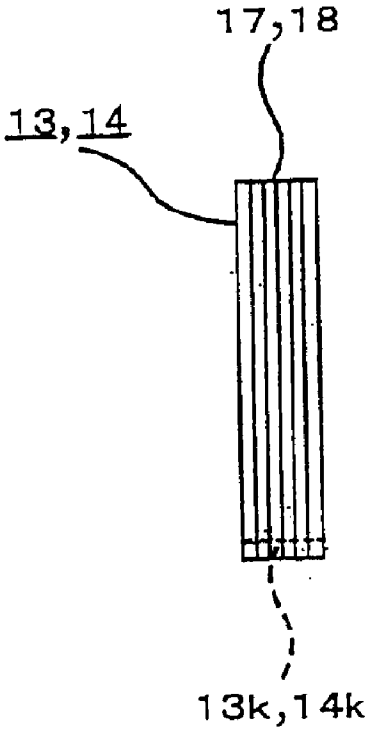
FIGS. 3A and 3B are a front view and a side view of third and fourth iron cores of FIGS. 1A and 1B.
Figure 3A:
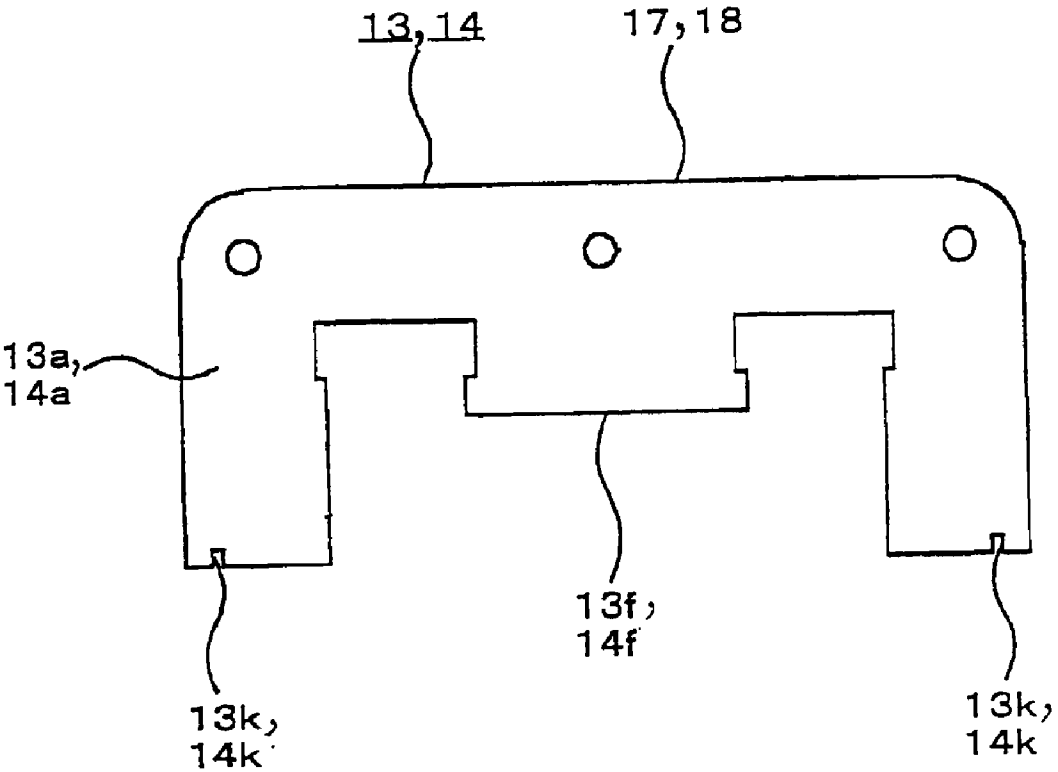

Referring to FIGS. 3A and 3B, the third iron core 13 has a generally U-shaped core portion (split core portion) 13*a*, a projecting magnetic pole portion 13*f* and grooves 13*k* formed in extreme end surfaces of the U-shaped core portion 13*a*. The third iron core 13 is shaped as if the first iron core 11 of FIGS. 2A and 2B is divided approximately into halves by a horizontal line. Both ends of the U-shaped core portion 13*a* extend like a pair of arms along the x-axis direction. Provided with these "arms" which are longer than the central projecting magnetic pole portion 13*f*, the U-shaped core portion 13*a* and the projecting magnetic pole portion 13*f* together form a generally E shape. The grooves 13*k* formed in the end surfaces of the "arms" are for fitting flanges 80*b* of the aforementioned bearings 80 which will be described later. The third iron core 13 is a sheet metal assembly formed by stacking and loosely bonding a specific number of ferromagnetic laminations 17.

The grooves 13*k* formed in the end surfaces of the U-shaped core portion 13*a* are cut in the x-axis direction. These grooves 13*k* are formed when the individual ferromagnetic laminations 17 are produced by punching a thin magnetic steel sheet. The fourth iron core 14 is also a sheet metal assembly formed by stacking a specific number of ferromagnetic laminations 18. Like the third iron core 13, the fourth iron core 14 has a generally U-shaped core portion 14*a*, a projecting magnetic pole portion 14*f* and grooves 14*k* formed in extreme end surfaces of the U-shaped core portion 14*a* (see FIGS. 3A and 3B).

The E-shaped third and fourth iron cores 13, 14 thus constructed are placed between the first iron core 11 and the second iron core 12 such that the third and fourth iron cores 13, 14 face each other along the x-axis (vertical) direction of FIG. 1A. The U-shaped core portions 13*a*, 14*a* of the third and fourth iron cores 13, 14 together form a generally square-shaped central closed core portion. This central closed core portion and the closed core portions 11*a*, 12*a* of the first and second iron cores 11, 12 are arranged such that they overlap one another as viewed along the y-axis direction. The central closed core portion and the closed core portions 11*a*, 12*a* together form a closed iron core assembly 10*a* of the fixed iron core unit 10, and the first and second iron cores 11, 12 and the third and fourth iron cores 13, 14 together constitute the fixed iron core unit 10. A space enclosed by the closed iron core assembly 10*a* serves as an armature accommodating space 10*b*.

The projecting magnetic pole portions 11*f*, 12*f* of the first and second iron cores 11, 12 and the projecting magnetic pole portions 13*f*, 14*f* of the third and fourth iron cores 13, 14 extending into the armature accommodating space 10*b* together constitute opposing magnetic poles 10*c*, 10*d* facing each other at a specific distance along the x-axis direction of FIG. 1A. The armature accommodating space 10*b* has open ends in both directions along the y-axis. As will be described later in detail, the aforementioned armature 41 and permanent magnets 50 are accommodated in the armature accommodating space 10*b* between the opposing magnetic poles 10*c*, 10*d*.

The coil 20 includes the aforementioned bobbin 21 and a winding 25. The bobbin 21 has a pair of generally square-shaped side plates 22, 23 and a cylindrical portion 24. Situated between facing inside surfaces of the side plates 22, 23, the cylindrical portion 24 interconnect the two side plates 22, 23. The side plate 22 has on its outside a pair of upper and lower steplike projections 22*a* raised in the axial direction (z-axis direction) of the bobbin 21. Similarly, the side plate 23 has on its outside a pair of upper and lower steplike projections 23*a* raised in the axial direction of the bobbin 21. The bobbin 21 including the side plates 22, 23 and the cylindrical portion 24 is a one-piece molded resin part.

The coil 30 has substantially the same structure as the coil 20. Specifically, the coil 30 includes the aforementioned bobbin 31 and a winding 35. The bobbin 31 has a pair of generally square-shaped side plates 32, 33 and a cylindrical portion 34 interconnecting the two side plates 32, 33. The side plate 32 has on its outside a pair of upper and lower steplike projections 32*a*, and the side plate 33 has on its outside a pair of upper and lower steplike projections 33*a*. Since outer peripheral portions of the bobbins 21, 31 are shaped such that they fit in the groovelike channels 11*e*, 12*e* formed in the first and second iron cores 11, 12 as shown in FIG. 1A, the bobbins 21, 31 are kept from being displaced along the x- and z-axis directions of FIG. 1A.

Figure 4B:
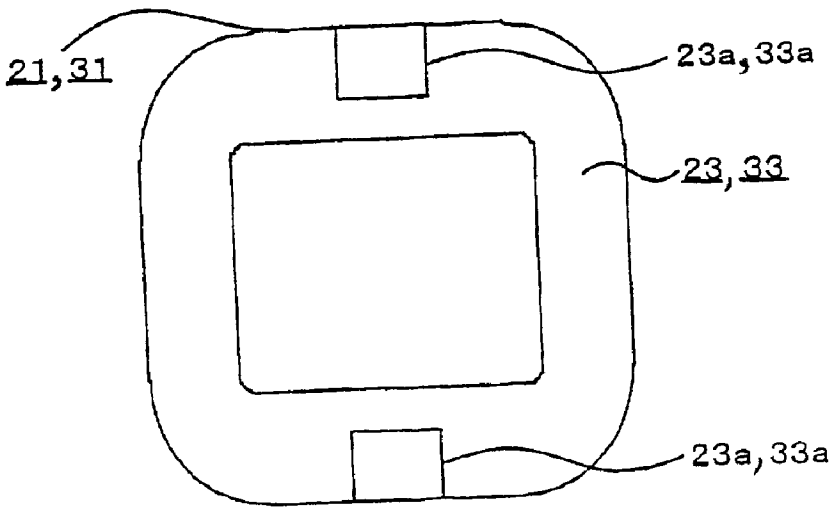
Figure 4A:
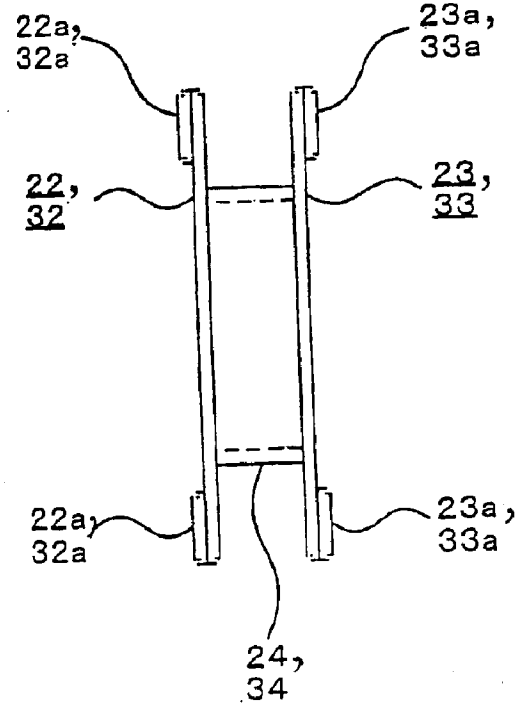

The coil 20 is kept from being displaced along the y-axis direction as the projections 22*a*, 23*a* of the bobbin 21 are securely sandwiched between the closed core portions 11*a* and 12*a* of the first and second iron cores 11, 12 from both left and right as illustrated in FIG. 1B (in the left-right directions as illustrated in FIG. 4B). It can be seen in FIG. 1B that the projections 22*a*, 23*a* of the bobbin 21 are sandwiched between the first and second iron cores 11, 12 and thereby kept from moving in the left-right directions as illustrated (in the left-right directions as illustrated in FIG. 4B). Similarly, the coil 30 is kept from being displaced along the y-axis direction as the projections 32*a*, 33*a* of the bobbin 31 are securely sandwiched between the closed core portions 11*a* and 12*a* of the first and second iron cores 11, 12 from both left and right as illustrated in FIG. 1B (in the left-right, directions as illustrated in FIG. 4B). Since there exist small gaps between outer peripheries of the coils 20, 30 and the third and fourth iron cores 13, 14, the third and fourth iron cores 13, 14 do not interfere with the coils 20, 30 when the coils 20, 30 are set in position by the first and second iron cores 11, 12.

An armature unit 40 includes the aforementioned armature 41 and support shafts 45, 46. The support shafts 45, 46 correspond to first and second rod members of the appended claims of this invention. The armature 41 has a through hole 41*a* formed through itself along the z-axis direction of FIGS. 1A and 1B and an internally threaded portion 41*b* formed in a middle portion of the through hole 41*a*. The armature 41 is made of magnetic steel formed into a parallelepiped-shaped block.

Made of nonmagnetic stainless steel, the support shaft 45 has an externally threaded portion 45*a* where external threads are formed and an unthreaded shank portion 45*b* having a smooth surface. The externally threaded portion 45*a* of the support shaft 45 is screwed into the internally threaded portion 41*b* and fixed therein and the shank portion 45*b* is supported by the through hole 41*a* formed in the armature 41.

Made also of nonmagnetic stainless steel, the support shaft 46 has an externally threaded portion 46*a* where external threads are formed and an unthreaded shank portion 46*b* having a smooth surface. The externally threaded portion 46*a* of the support shaft 46 is screwed into the internally threaded portion 41*b* and fixed therein and the shank portion 46*b* is supported by the through hole 41*a* formed in the armature 41.

The permanent magnets 50 are made of ferrite, for example, formed into rectangular thick sheets. The upper and lower support plates 60 each have a bent portion 60*a* which are perpendicular to the horizontal as illustrated in FIGS. 5A and 5B. Made of a magnetic material, each support plate 60 is formed into an L shape in side view. The support plates 60 are fixed to side surfaces of the armature 41 by fixing screws 68 in such a manner that narrow gaps are created between the support plates 60 and the opposing magnetic poles 10*c*, 10*d*. The permanent magnets 50 are attracted by their own magnetic forces to upper and lower surfaces of the armature 41 and secured thereto by the support plates 60 which cover and press against outer surfaces of the permanent magnets 50. The width of each permanent magnet 50 (as measured in the left-right directions of FIG. 1B) is approximately equal to the width of the armature 41 and the length of each permanent magnet 50 (as measured in the left-right directions of FIG. 1A) is smaller than the length of the armature 41. The upper and lower permanent magnets 50 thus structured are fixed to the armature 41 at positions shown in FIGS. 1A and 1B.

Figure 6B:
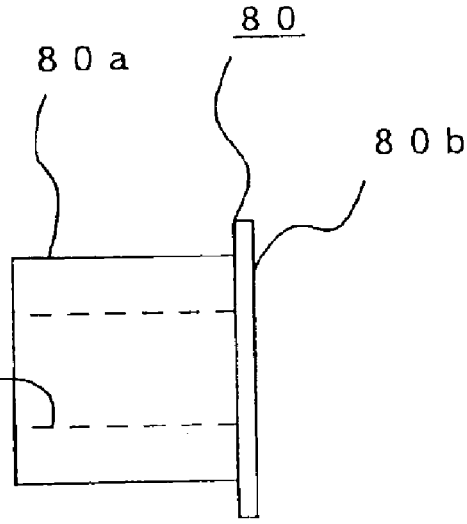
Figure 7:
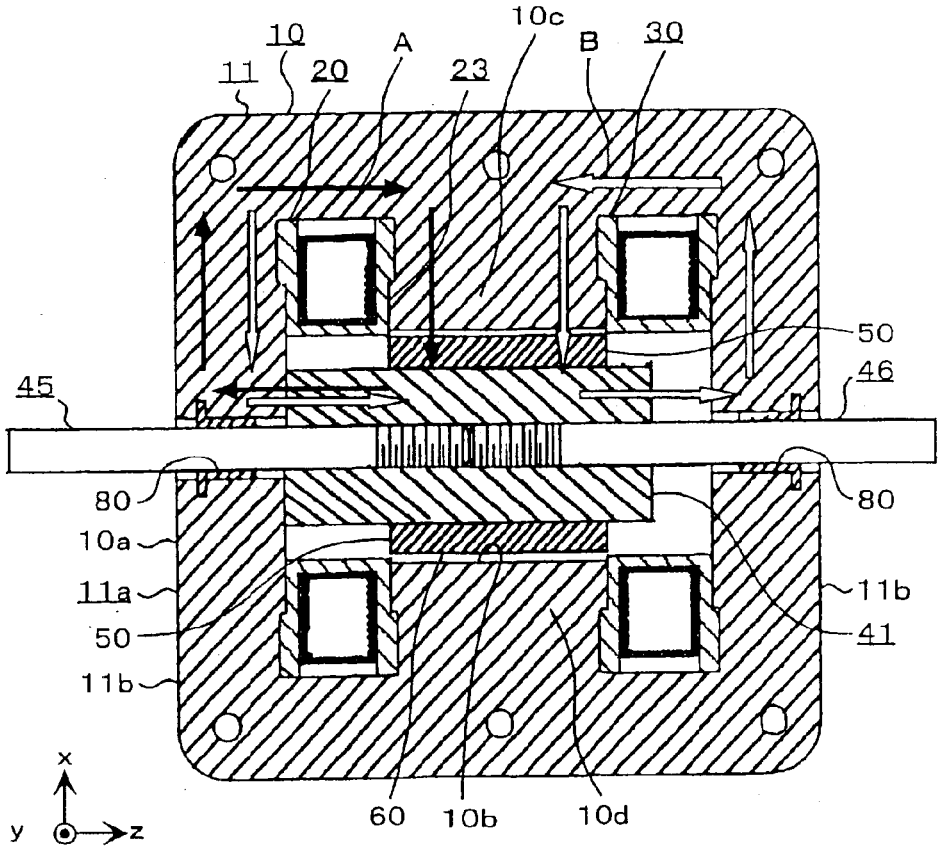
FIG. 7 is a diagram illustrating the working of the actuator of the first embodiment.

Referring to FIGS. 6A and 6B, the bearings 80 each have a parallelepiped-shaped portion (main portion) 80*a* and the aforementioned flanges 80*b* which are flat-shaped projecting portions extending upward and downward from the parallelepiped-shaped portion 80*a* as illustrated in FIGS. 6A and 6B. Each bearing 80 has in its central part a through hole 80*c* having a circular cross section through which the support shaft 45 or 46 is passed. Each bearing 80 is a one-piece component made of copper-alloy-based sintered metal. The dimension of the parallelepiped-shaped portion 80*a* of each bearing 80 is made equal to the dimension of the third and fourth iron cores 13, 14 as measured along the y-axis direction of FIG. 1A.

As both extreme ends of the third and fourth iron cores 13, 14 come in contact with the main portions 80*a* of the individual bearings 80, facing at a specific distance along the x-axis (vertical) direction, the bearings 80 are set at fixed positions in the x-axis direction. As the grooves 13*k*, 14*k* formed in the third and fourth iron cores 13, 14 fit on the upper and lower flanges 80*b* of the bearings 80 from top and bottom sides, the bearings 80 are kept from being displaced along the z-axis direction. Also, as the bearings 80 are sandwiched between the first iron core 11 and the second iron core 12, they are set in position in the y-axis direction. It is to be noted, however, that small gaps exist between the grooves 13*k*, 14*k* and the flanges 80*b* of the individual bearings 80 in the x-axis direction, and the bearings 80 are securely held between both extreme ends of the third and fourth iron cores 13, 14 at fixed positions in the x-axis direction.

As viewed along the y-axis direction of FIGS. 1A and 1B, the U-shaped core portion 13*a* of the third iron core 13 and the closed core portions 11*a*, 12*a* of the first and second iron cores 11, 12 almost perfectly overlap one another, and the U-shaped core portion 14*a* of the fourth iron core 14 and the closed core portions 11*a*, 12*a* of the first and second iron cores 11, 12 almost perfectly overlap one another. Also, as viewed along the y-axis direction, the projecting magnetic pole portion 13*f* of the third iron core 13 and the projecting magnetic pole portions 11*f*, 12*f* of the first and second iron cores 11, 12 almost perfectly overlap one another, and the projecting magnetic pole portion 14*f* of the fourth iron core 14 and the projecting magnetic pole portions 11*f*, 12*f* of the first and second iron cores 11, 12 almost perfectly overlap one another.

The parallelepiped-shaped portions 80*a* of the individual bearings 80 support the armature unit 40 by its support shafts 45, 46 in a manner that the armature unit 40 can move back and forth along the z-axis direction. Ideally, there exist specific narrow gaps between the support plates 60 and the opposing magnetic poles 10*c*, 10*d*, and between the support plates 60 and the coils 20, 30, in the x-axis direction. Due to the provision of the support plates 60, however, the friction of sliding, which would occur if the opposing magnetic poles 10*c*, 10*d* or inside portions of the bobbins 21, 31 of the coils 20, 30 slide along the support plates 60, is sufficiently small so that no adverse effects would occur on their sliding action.

The first and second iron cores 11, 12 are fastened, together with the third and fourth iron cores 13, 14 placed in between, by six bolts 19 passed through six small holes in the fixed iron core unit 10 shown in FIGS. 1A and 1B to form a single structure. With this arrangement, the first and second iron cores 11, 12 tightly sandwich the upper and lower projections 22*a*, 23*a* of the bobbin 21 and the upper and lower projections 32*a*, 33*a* of the bobbin 31 from the left and right directions as illustrated in FIG. 4B, holding the coils 20, 30 at fixed positions in the y-axis direction. The bobbins 21, 31 are securely fitted in the groovelike channels

11*e*, 12*e* formed in the first and second iron cores 11, 12 almost immovably in the x-axis (vertical) direction. The bobbins 21, 31 are fitted in such a way that they do not move beyond extremely small specific distances in either the x- or z-axis direction even when the friction of sliding acting in the x- and z-axis directions between the first and second iron cores 11, 12 and the projections 22*a*, 23*a*, 32*a*, 33*a* of the bobbins 21, 31 is lost due to aging of the bobbins 21, 31, for instance.

The bobbins 21, 31 are kept from being displaced along the y-axis direction as well with the provision of the projections 22*a*, 23*a*, 32*a*, 33*a* even when the first and second iron cores 11, 12 no longer tightly sandwich the projections 22*a*, 23*a*, 32*a*, 33*a* of the bobbins 21, 31 with great force due to aging of the bobbins 21, 31, for instance. Therefore, the bobbins 21, 31 are held at precise positions in the x-, y- and z-axis directions and do not move from their original positions beyond specific amounts even when they have embrittled with the lapse of time.

Described below is how the actuator of the embodiment is assembled. First, with the support shafts 45, 46 screwed into the through hole 41*a* in the armature 41, the coil 20 and one bearing 80 are passed over the support shaft 45, and the coil 30 and the other bearing 80 are passed over the support shaft 46. At this point, the permanent magnets 50 are not attached to the armature 41 yet. Next, the coils 20, 30 are set at approximate positions in the z-axis direction shown in FIGS. 1A and 1B, and the flanges 80*b* of the individual bearings 80 are set in position by fitting them in the grooves 13*k* in the third iron core 13 and in the grooves 14*k* in the fourth iron core 14.

Subsequently, the outer peripheral portions of the bobbins 21, 31 are fitted in the respective groovelike channels 11*e*, 12*e*, and the upper and lower projections 22*a*, 23*a* of the bobbin 21 and the upper and lower projections 32*a*, 33*a* of the bobbin 31 are sandwiched by the first and second iron cores 11, 12 from the left and right directions as illustrated in FIG. 1B to set the bobbins 21, 31 in position. At this point, the armature accommodating space 10*b* is formed by the surrounding first to fourth iron cores 11-14 and the armature 41 is accommodated in this armature accommodating space 10*b*. Since the permanent magnets 50 are not attached to the armature 41 yet, the armature 41 is not attracted by either the magnetic pole 10*c* or the magnetic pole 10*d* when assembled. This makes it possible to set the bearings 80 at correct positions with ease and precision.

Then, the upper and lower permanent magnets 50 individually fitted with the L-shaped support plates 60, which have been magnetized together, are inserted into gaps between the armature 41 and the upper and lower projecting magnetic pole portions 11*f*, 12*f*, 13*f*, 14*f* from the left side as illustrated in FIG. 1B, for example. When inserted, the permanent magnets 50 are attracted by their own magnetic forces to the upper and lower surfaces of the armature 41, respectively. The bent portions 60*a* of the individual support plates 60 are fixed to the side surfaces of the armature 41 by the fixing screws 68 whereby the permanent magnets 50 and the support plates 60 are set in fixed positions (see FIGS. 5A and 5B).

According to the aforementioned method of assembly, the coils 20, 30, the bearings 80 and the armature 41 in which the support shafts 45, 46 are screwed can be set at correct positions with ease and high precision, ensuring smooth movement of the armature 41 and high reliability of the actuator.

The working of the actuator of this embodiment is now described hereunder.

When the coils 20, 30 are not exited, magnetic fluxes formed by the permanent magnets 50 pass through magnetic circuits as shown by black arrows A in FIG. 7. Under this condition, the armature 41 moves leftward as illustrated in FIG. 7 and is held in contact with a left-hand inside surface of the closed iron core assembly 10*a* which is formed of the closed core portions 11*a*, 12*a* of the first and second iron cores 11, 12 and the U-shaped core portions 13*a*, 14*a* of the third and fourth iron cores 13, 14.

If the coil 30 is exited, it produces magnetic fluxes passing through magnetic circuits as shown by outline arrows B in FIG. 7. These magnetic fluxes cancel out the magnetic fluxes formed by the permanent magnets 50 which keep the armature 41 at the left-hand inside surface of the closed iron core assembly 10*a*, and produce an attractive force exerted between the armature 41 and a right-hand inside surface of the closed iron core assembly 10*a*. This attractive force causes the armature 41 to move rightward by a specific distance so that the armature 41 goes into contact with the right-hand inside surface of the closed iron core assembly 10*a*. Even if the coil 30 is de-excited at this point, the armature 41 is still held in contact with the right-hand inside surface of the closed iron core assembly 10*a* by the magnetic fluxes formed by the permanent magnets 50.

If the coil 20 is exited next, the armature 41 moves leftward according to the same principle of operation as explained above and returns to the left-hand position shown in FIG. 7. In this embodiment, the two coils 20, 30 may be excited simultaneously while properly controlling the directions of exciting currents so that the armature 41 moves at a higher speed. A switching device, such as a vacuum switch, of a power supply circuit breaker connected to the support shaft (rod member) 45 or 46 of the armature 41 is driven in the aforementioned manner.

As is recognized from the foregoing discussion of the present embodiment, the bobbins 21, 31 are kept from being displaced along the y-axis direction as their projections 22*a*, 23*a*, 32*a*, 33*a* are sandwiched between the first and second iron cores 11, 12, and the bobbins 21, 31 are made movable by only the extremely small specific distances in the x- and z-axis directions even when the friction of sliding (sandwiching force) exerted by the first and second iron cores 11, 12 is lost as the bobbins 21, 31 are fitted in the groovelike channels 11*e*, 12*e* formed in the first and second iron cores 11, 12. According to this construction, it is possible to easily set the coils 20, 30 at correct positions since the bobbins 21, 31 are held at precise positions in the x-, y- and z-axis directions and, therefore, the coils 20, 30 are not displaced beyond specific distances by shocks caused by movements of the armature 41 or even when the bobbins 21, 31 made of an insulating material have embrittled with the lapse of time. This makes it possible to reduce the dimensions of the inside portions of the bobbins 21, 31 as well as ampere-turn values of the coils 20, 30 and achieve a reduction in their size and weight.

As already stated, the friction of sliding, which would occur if the opposing magnetic poles 10*c*, 10*d* or the inside portions of the bobbins 21, 31 of the coils 20, 30 slide along the support plates 60, is sufficiently small due to the provision of the support plates 60 so that no adverse effects would occur. The dimensions of the inside portions of the bobbins 21, 31 can be reduced from this point of view as well. In addition, even if the opposing magnetic poles 10*c*, 10*d* more or less slide along the support plates 60 as a result of a reduction in the gaps between them, this sliding action does not cause the risk of interfering with their normal operation. It is therefore possible to further reduce the necessary ampere-turn values of the coils 20, 30 and achieve a further reduction in their size and weight.

Since the support shafts 45, 46 are made of a nonmagnetic material, magnetic paths formed by the coils 20, 30 through the support shafts 45, 46 have an extremely larger reluctance than surrounding parts of the fixed iron core unit 10. It is therefore possible to reduce leakage fluxes escaping into the support shafts 45, 46 and the ampere-turn values for exciting the coils 20, 30.

The externally threaded portions 45*a*, 46*a* of the support shafts 45, 46 are screwed into the internally threaded portion 41*b* of the armature 41 and the unthreaded shank portions 45*b*, 46*b* of the support shafts 45, 46 are supported by the through hole 41*a* formed in the armature 41. This construction helps prevent the occurrence of an excessive stress at the root of the threads cut around the externally threaded portions 45*a*, 46*a* even when a force is exerted on the support shafts 45, 46 at right angles to their axial direction.

The shank portions 45*b*, 46*b* of the support shafts 45, 46 withstand an approximately 10 times larger shearing stress than the externally threaded portions 45*a*, 46*a* which are screwed into the armature 41. This helps prevent shearing of the support shafts 45, 46 due to bending when they are subjected to a strong impact. The support shafts 45, 46 are screwed into the armature 41 from both ends thereof along its axial direction. This helps prevent loosening of the externally threaded portions 45*a*, 46*a* fitted in the internally threaded portion 41*b* of the armature 41 when the support shafts 45, 46 are subjected to mutual compression as a result of their movement along the axial direction. All these features serve to improve the reliability of operation of the actuator.

The upper and lower flanges 80*b* of the bearings 80 are fitted in the grooves 13*k*, 14*k* formed in the U-shaped core portions 13*a*, 14*a* of the third and fourth iron cores 13, 14 and the bearings 80 are sandwiched between the first and second iron cores 11, 12 from top and bottom along the y-axis direction of FIG. 1B. Since the bearings 80 are set at correct positions in the x-, y- and z-axis directions, the two bearings 80 can be positioned on a common axis with high accuracy. This makes it possible to reduce gaps between the armature 41 and the opposing magnetic poles 10*c*, 10*d*, and between the armature 41 and the inside portions of the bobbins 21, 31, as well as the exciting current capacity of the coils 20, 30.

Although it might be possible to bore holes in a laminated core for mounting bearings, it is necessary to machine the core by using a jig to make such mounting holes with high accuracy while exercising care to prevent deformation of the core. In contrast, the third and fourth iron cores 13, 14 are formed by stacking the ferromagnetic laminations 17, 18 produced by high-precision sheet metal punching, so that it is possible to mount the bearings 80 with high accuracy as stated above in the present embodiment.

According to the aforementioned construction of the embodiment, the bearings 80 are sandwiched between the third and fourth iron cores 13, 14 which constitute upper and lower halves of the central closed core portion. In this construction, the armature unit 40 can be easily assembled in the fixed iron core unit 10 after screwing the support shafts 45, 46 into the armature 41 and fitting the bearings 80 on the individual support shafts 45, 46. Although the two separate support shafts 45, 46 are used in the embodiment, a single round rod may be fitted in the armature 41 along its axial direction and affixed thereto by welding, for example.

In this embodiment, the coils 20, 30 are fitted in the groovelike channels 11*e*, 12*e* formed in the first and second iron cores 11, 12 so that the coils 20, 30 are kept from being displaced along the x- and z-axis directions. Alternatively, only the groovelike channels 11*e* formed in the first iron core 11 may be used to fit the coils 20, 30 and hold them at fixed positions. In this alternative, the groovelike channels 12*e* formed in the second iron core 12 between the projecting magnetic pole portions 12*f* and the left and right yoke portions 12*b* may have low dimensional accuracy. This alternative makes it possible to reduce manufacturing cost.

Second Embodiment

Figure 8B:
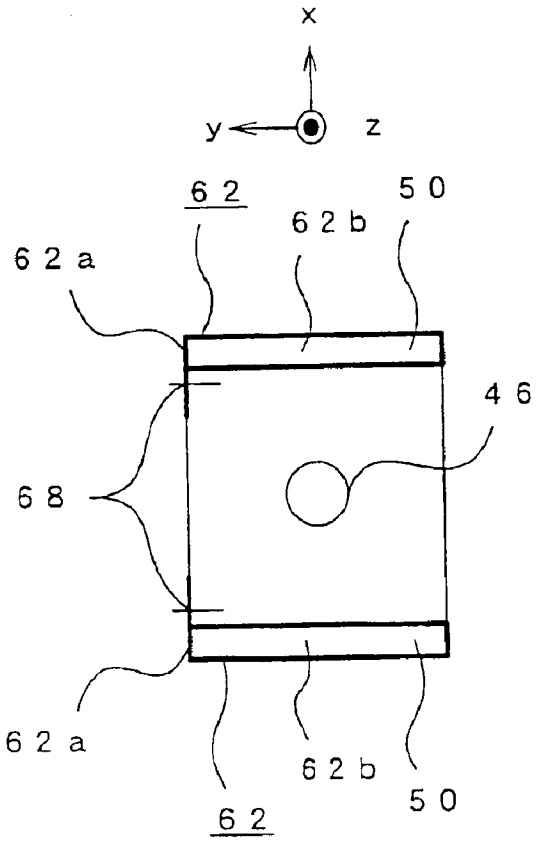
FIGS. 8A and 8B are enlarged views of principal parts of an actuator according to a second embodiment of the invention.
Figure 8A:
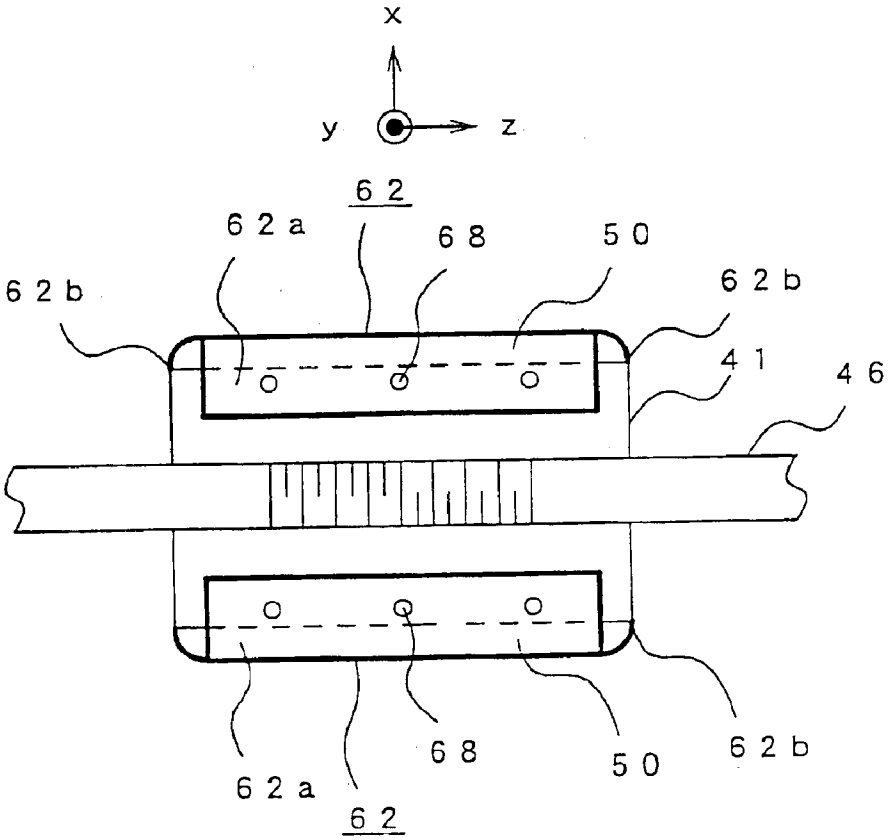

FIGS. 8A and 8B are enlarged views of principal parts of an actuator according to a second embodiment of the invention, in which elements identical or similar to those shown in FIGS. 1A, 1B, 2A, 2B, 3A, 3B, 4A, 4B, 4C, 5A, 5B, 6A, 6B and 7 are designated by the same reference numerals.

Referring to FIGS. 8A and 8B, upper and lower support plates 62 made of a magnetic material each have a bent portion 62*a* and a pair of curved portions 62*b* extending leftward and rightward. Like the bent portions 60*a* of FIGS. 5A and 5B, the bent portions 62*a* are fixed to the armature 41 by fixing screws 68.

The curved portions 62*b* are formed by inwardly bending both ends of the each support plate 62 which extend leftward and rightward in the moving direction (axial direction) of the armature 41 in such a way that the curved portions 62*b* grasp each permanent magnet 50 from both left and right along the z-axis direction. In this embodiment, the length of each permanent magnet 50 is made shorter than the length of the armature 41 so that the curved portions 62*b* are kept within the length of the armature 41 and do not interfere with the closed iron core assembly 10*a* when the armature 41 driven in its axial direction goes into contact with the left-hand or right-hand inside surface of the closed iron core assembly 10*a*. The permanent magnets 50 are fixed to the armature 41 by the support plates 62 of which bent portions 62*a* are affixed to the side surfaces of the armature 41 by the fixing screws 68. Fixed to the armature 41, the support plates 62 covering and pressing against the outer surfaces of the permanent magnets 50 may slide along the opposing magnetic poles 10*c*, 10*d* or the inside portions of the bobbins 21, 31 of the coils 20, 30 particularly on a lower side of FIG. 1A.

Even if the support plates 62 slide along the opposing magnetic poles 10*c*, 10*d* or the inside portions of the bobbins 21, 31 of the coils 20, 30, the support plates 62 ensure smooth sliding motion because their friction of sliding is so small and the curved portions 62*b* serve as guide surfaces. The provision of these support plates 62 having the curved portions 62*b* makes it possible to significantly reduce gaps between the support plates 62 and the opposing magnetic poles 10*c*, 10*d* and efficiently use attractive forces exerted on the armature 41 in an improved fashion. This makes it possible to reduce the necessary ampere-turn values and size of the coils 20, 30 and achieve a reduction in the size and cost of the actuator and an improvement in its reliability.

Third Embodiment

Figure 9B:
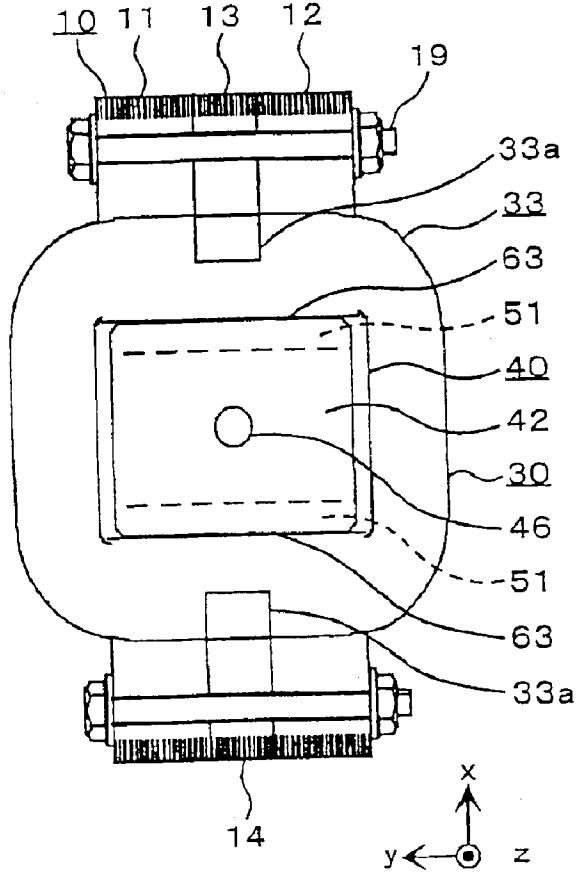
FIGS. 9A and 9B are sectional diagrams showing the construction of an actuator according to a third embodiment of the invention.
Figure 9A:
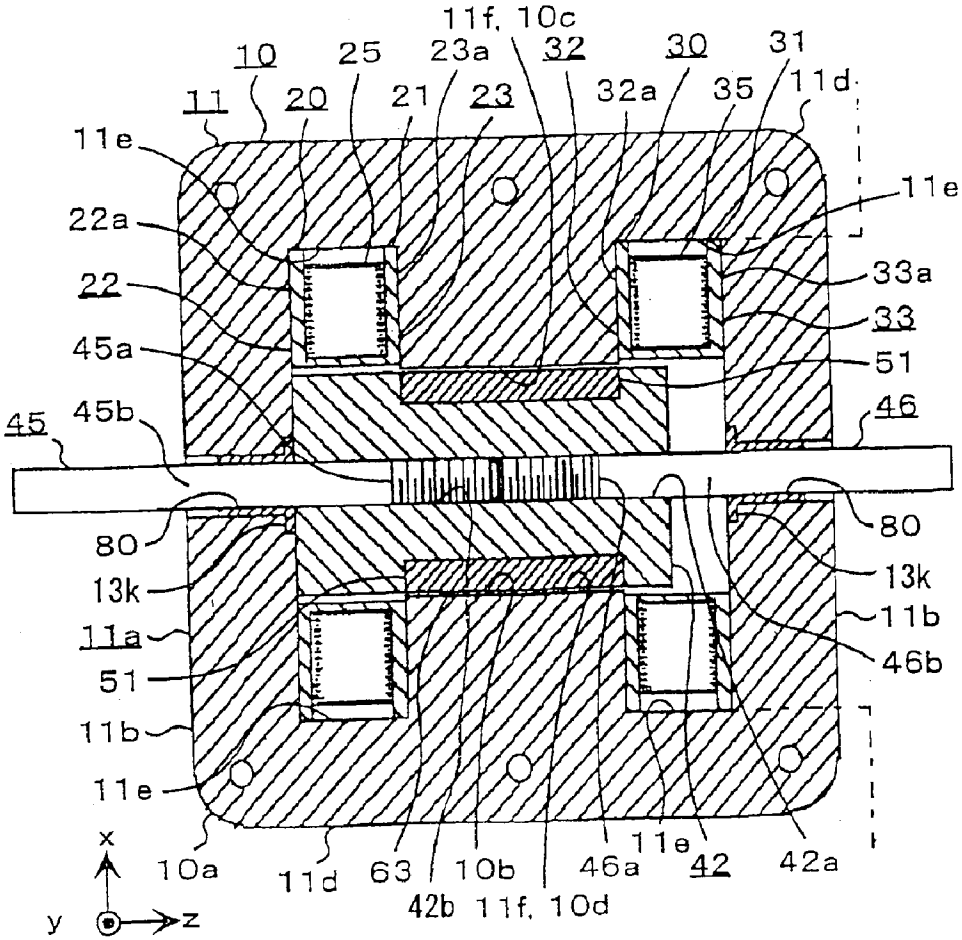

FIGS. 9A and 9B are sectional diagrams showing the construction of an actuator according to a third embodiment of the invention, in which elements identical or similar to those of the foregoing embodiments are designated by the same reference numerals.

While the permanent magnets 50 protrude from the upper and lower surfaces of the armature 41 in the first and second embodiments, the actuator of the third embodiment employs an armature 42 formed into a parallelepiped-shaped block having a larger thickness than the armature 41 of FIGS. 1A and 1B as measured in the x-axis (vertical) direction. In this embodiment, permanent magnets 51 are embedded in rectangular recesses formed in the upper and lower surfaces of the armature 42, and upper and lower support plates 63 made of a magnetic material are fitted to outer surfaces of the permanent magnets 51 in such a fashion that the individual support plates 63 become flush with the upper and lower surfaces of the armature 42 as illustrated in FIG. 9A.

The armature 42 of this embodiment has a through hole 42*a* formed through itself along the z-axis direction of FIGS. 9A and 9B and an internally threaded portion 42*b* formed in a middle portion of the through hole 42*a*. The through hole 42*a* and the internally threaded portion 42*b* are similar to the through hole 41*a* and the internally threaded portion 41*b* formed in the armature 41 of the first embodiment shown in FIGS. 1A and 1B. Each support plate 63 is formed into an L shape in side view and its bent portion is fixed to the armature 42 by fixing screws 68 like the support plates 60 of FIGS. 5A and 5B. The friction of sliding which would occur if the support plates 63 slide along the opposing magnetic poles 10*c*, 10*d* or the inside portions of the bobbins 21, 31 of the coils 20, 30 is sufficiently small in this embodiment as well.

Fourth Embodiment

Figure 10B:
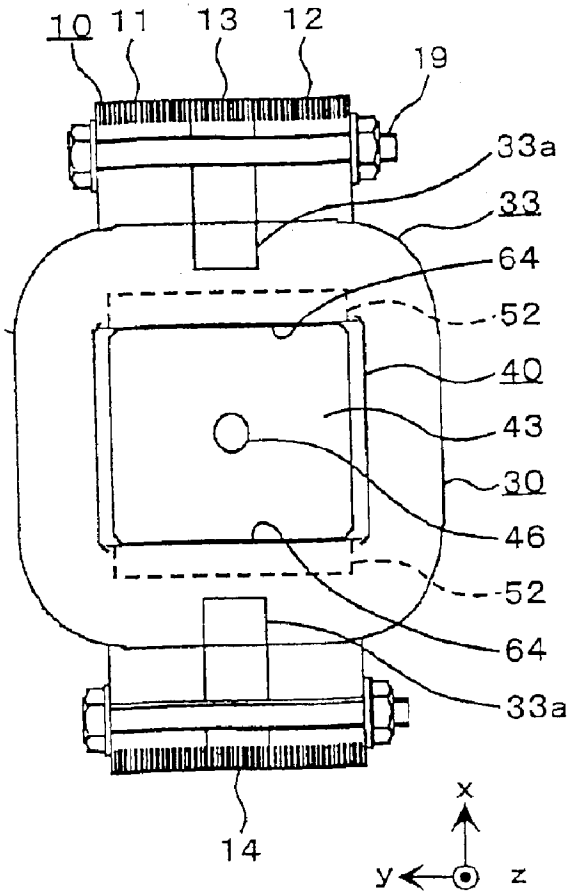
FIGS. 10A and 10B are sectional diagrams showing the construction of an actuator according to a fourth embodiment of the invention.
Figure 10A:
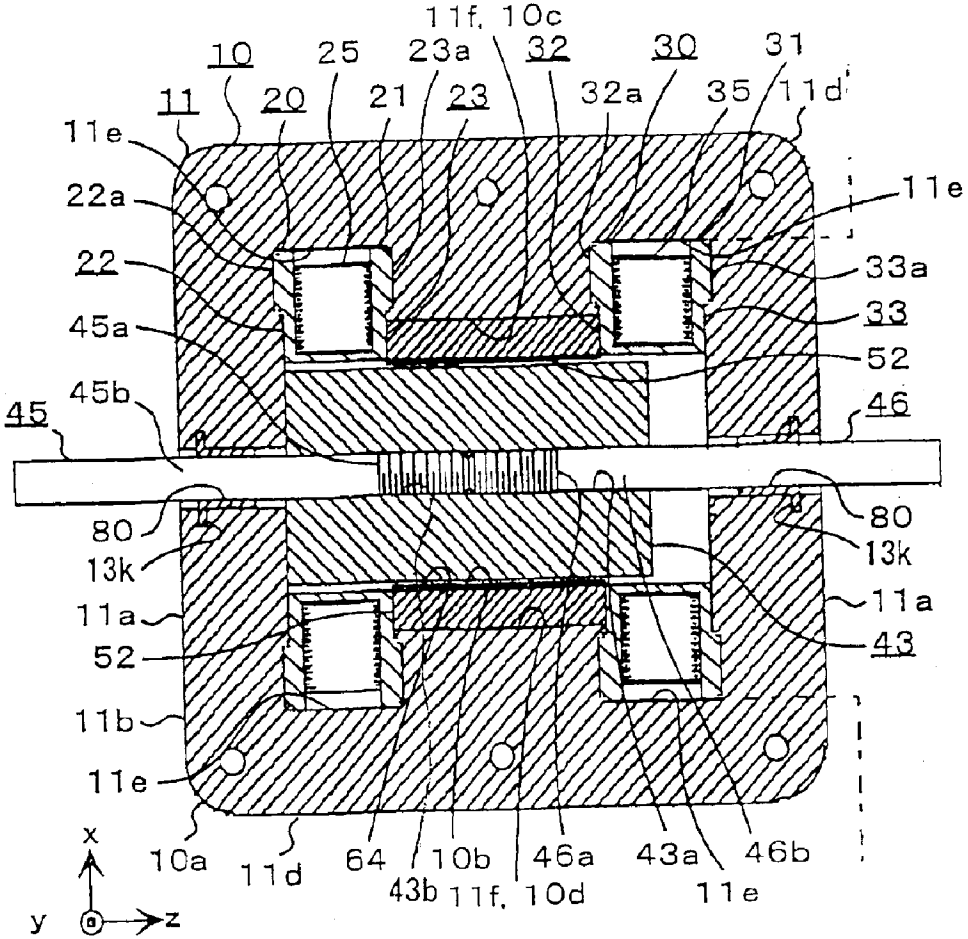

FIGS. 10A and 10B are sectional diagrams showing the construction of an actuator according to a fourth embodiment of the invention, in which elements identical or similar to those of the foregoing embodiments are designated by the same reference numerals.

Referring to FIGS. 10A and 10B, the actuator of the fourth embodiment employs an armature 43 formed into a parallelepiped-shaped block having a larger thickness than the armature 41 of FIGS. 1A and 1B as measured in the x-axis (vertical) direction. The armature 43 of this embodiment has a through hole 43*a* formed through itself along the z-axis direction of FIGS. 10A and 10B and an internally threaded portion 43*b* formed in a middle portion of the through hole 43*a*. The through hole 43*a* and the internally threaded portion 43*b* are similar to the through hole 41*a* and the internally threaded portion 41*b* formed in the armature 41 of the first embodiment shown in FIGS. 1A and 1B. In this embodiment, the distance between the opposing magnetic poles 10*c*, 10*d* is made larger than shown in FIGS. 1A and 1B, and stationary permanent magnets 52 and support plates 64 are together fixed to surfaces of the magnetic poles 10*c*, 10*d* facing the armature 43.

Having the same shape as the support plates 62 shown in FIGS. 8A and 8B, the support plates 64 cover surfaces of the stationary permanent magnets 52 facing the armature 43. These support plates 64 also have curved portions similar to the curved portions 62*b* shown in FIGS. 8A and 8B, but the curved portions of the support plates 64 are bent in directions going away from the armature 43 to grasp each stationary permanent magnet 52 from both left and right along the axial direction (z-axis direction) of the armature 43. The upper support plate 64 illustrated in FIGS. 10A and 10B is fixed to the first iron core 11 securely holding the upper stationary permanent magnet 52 against the magnetic pole 10*c*, while the lower support plate 64 is fixed to the first iron core 11 securely holding the lower stationary permanent magnet 52 against the magnetic pole 10*d*. Each support plate 64 is formed into an L shape in side view and its bent portion is fixed to the first iron core 11 by fixing screws 68 like the support plates 60 of FIGS. 5A and 5B.

Fifth Embodiment

Figure 11:
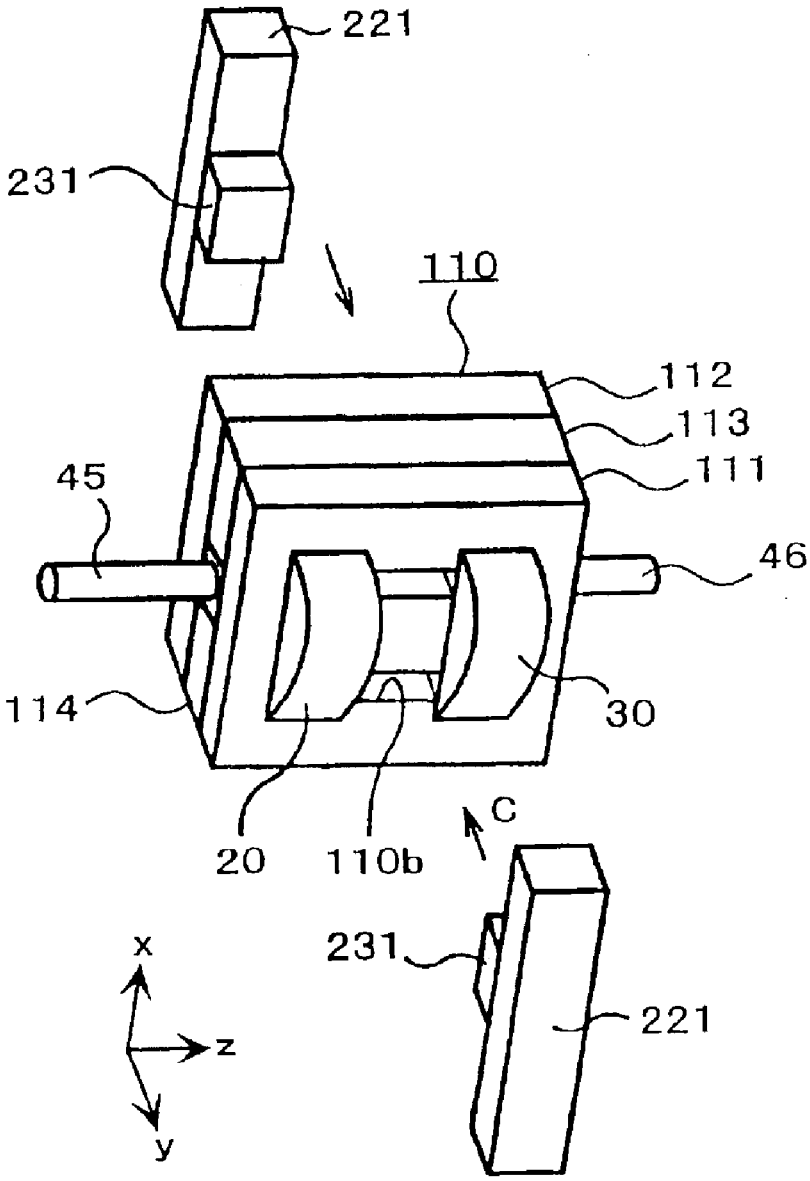
FIG. 11 is a partially exploded perspective diagram showing the construction of an actuator according to a fifth embodiment of the invention.
Figure 12:
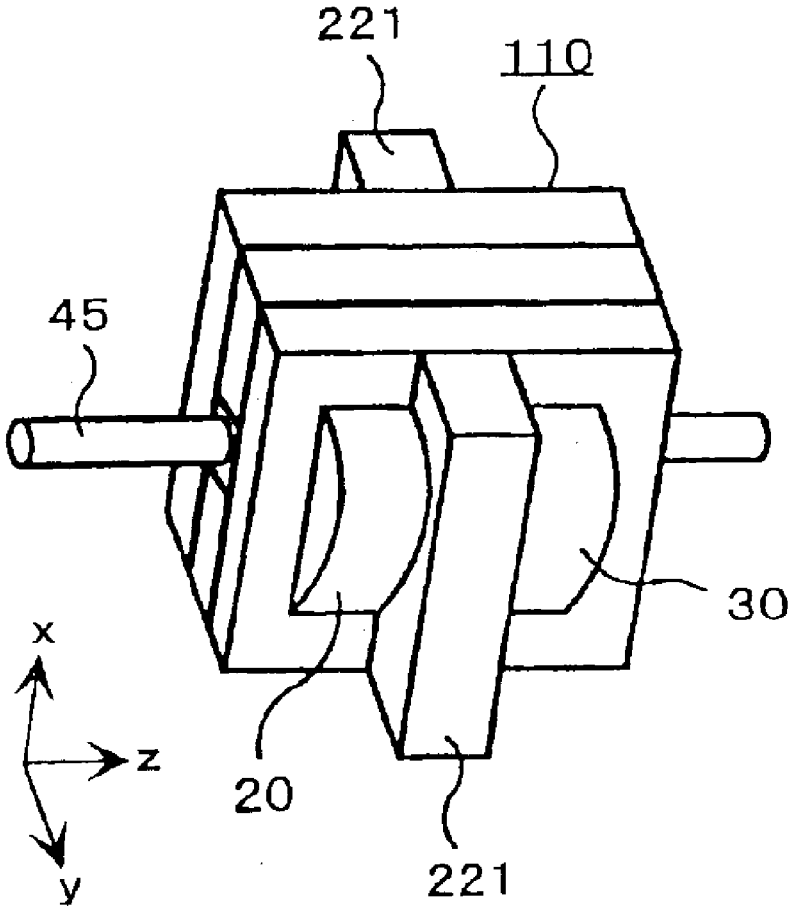
FIG. 12 is a perspective assembly diagram of the actuator of FIG. 11.
Figure 13:
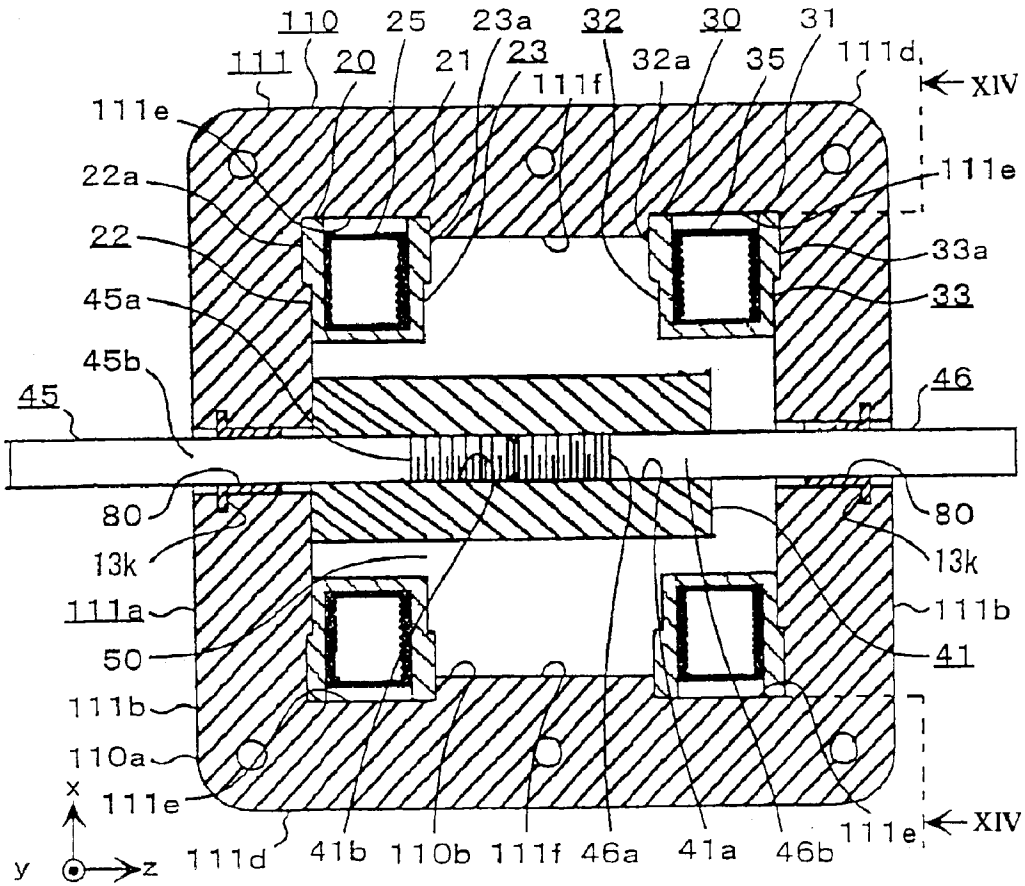
FIG. 13 is a sectional diagram showing the detailed construction of the actuator of FIG. 11.
Figure 14:
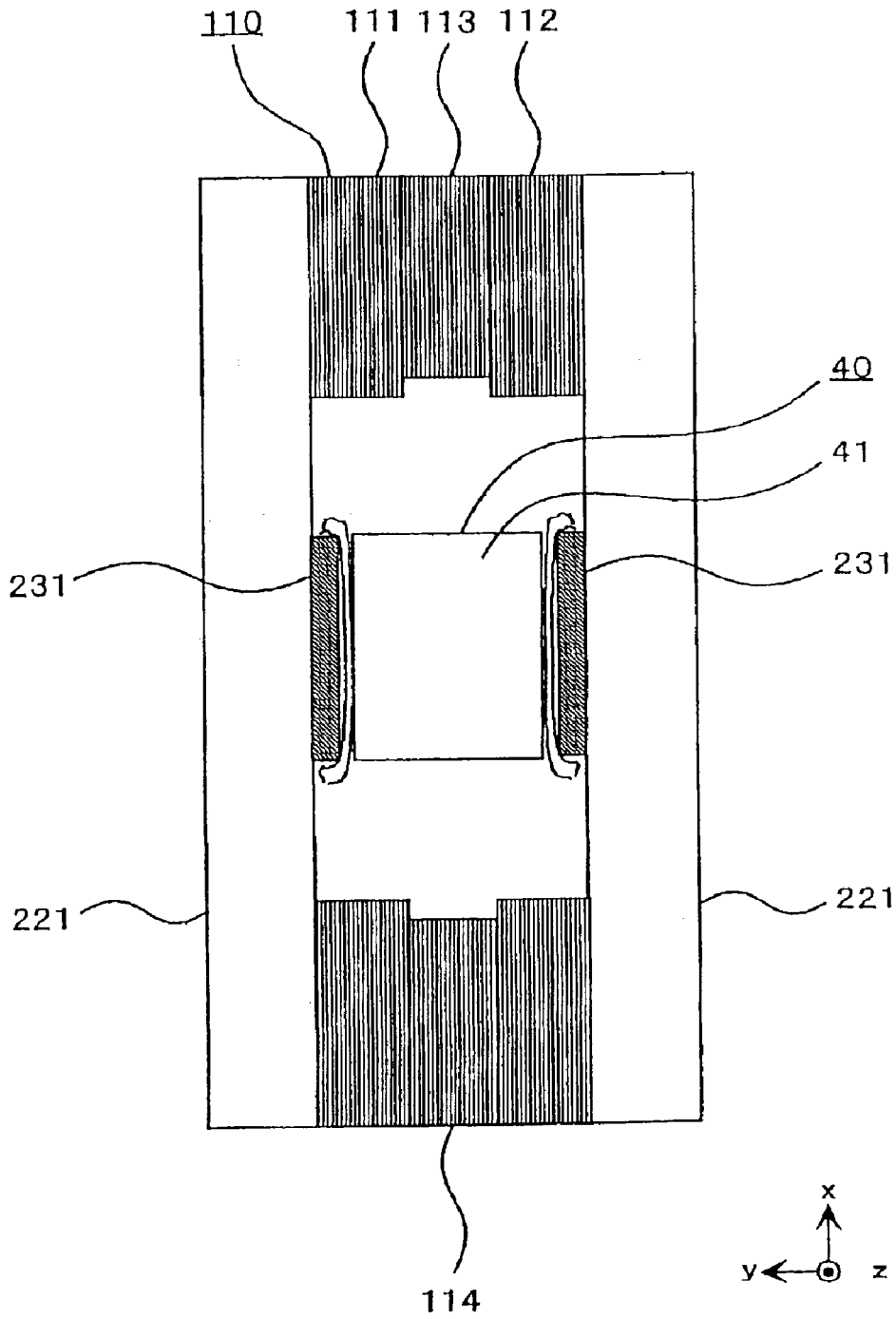
FIG. 14 is a sectional diagram taken along lines XIV—XIV of FIG. 13 with coils removed.
Figure 15B:
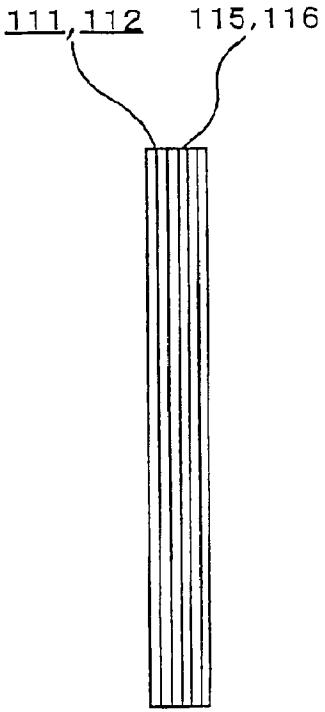
FIGS. 15A and 15B are a front view and a side view of first and second iron cores of FIG. 11.
Figure 15A:
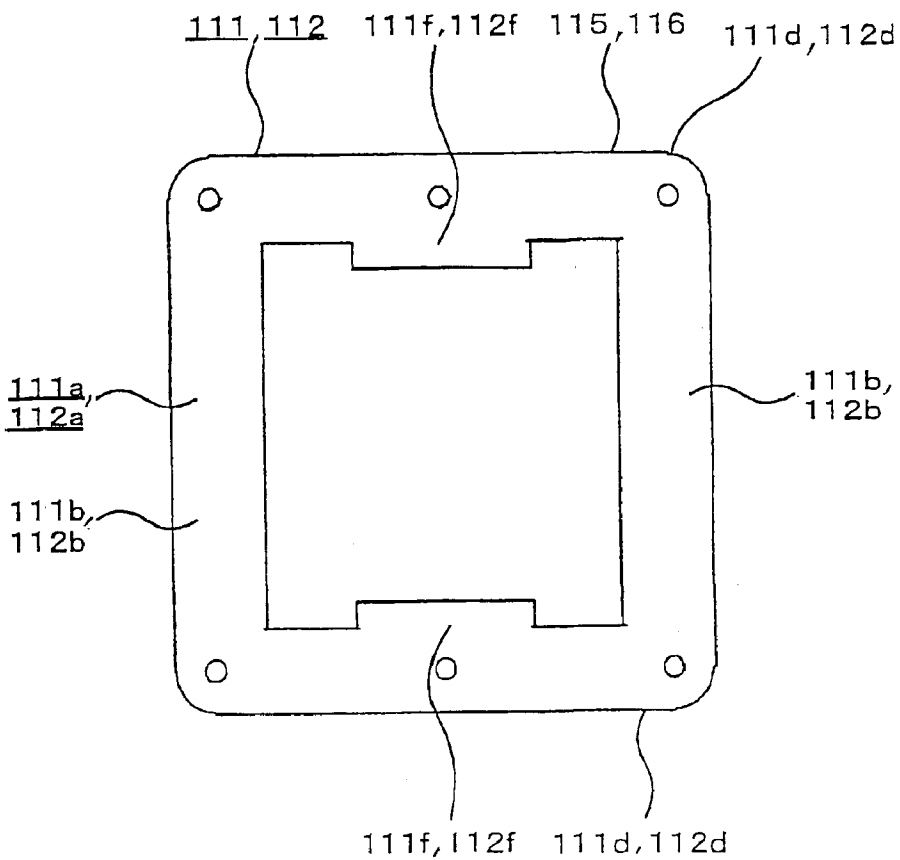
Figure 16B:
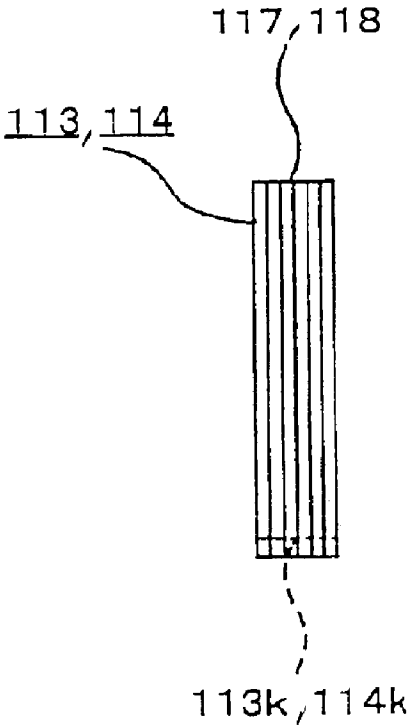
FIGS. 16A and 16B are a front view and a side view of third and fourth iron cores of FIG. 11.
Figure 16A:
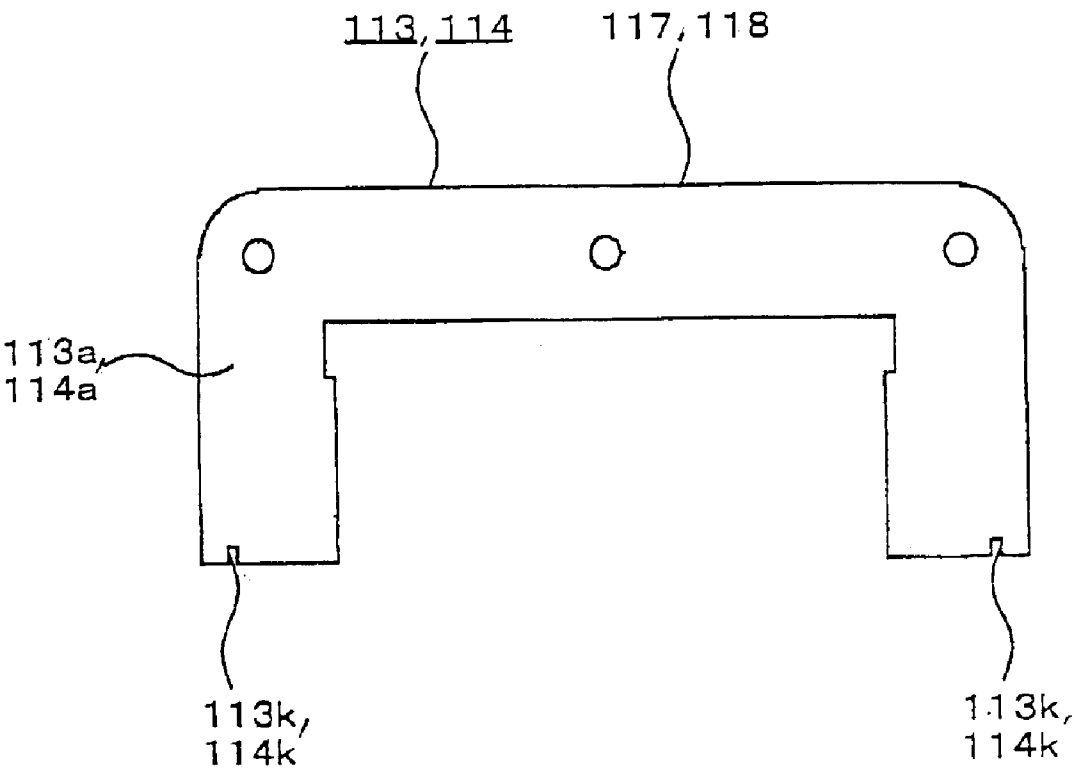

FIGS. 11, 12, 13, 14, 15A, 15B, 16A and 16B are diagrams showing an actuator according to a fifth embodiment of the invention, in which elements identical or similar to those of the foregoing embodiments are designated by the same reference numerals. FIG. 11 is a partially exploded perspective diagram showing the construction of the actuator, FIG. 12 is a perspective assembly diagram of the actuator, FIG. 13 is a sectional diagram showing the detailed construction of the actuator, FIG. 14 is a sectional diagram taken along lines XIV—XIV of FIG. 13 with coils 20, 30 removed, FIGS. 15A and 15B are a front view and a side view of first and second iron cores 111, 112, FIGS. 16A and 163 are a front view and a side view of third and fourth iron cores 113, 114.

Referring to FIG. 11, a fixed iron core unit 110 includes the aforementioned first to fourth iron cores 111–114. The first iron core 111 and the second iron core 112 are situated on opposite sides at a specific distance from each other in the y-axis direction. The third iron core 113 and the fourth iron core 114 are placed between the first iron core 111 and the second iron core 112 such that the third iron core 113 and the fourth iron core 114 face each other along the x-axis (vertical) direction shown in FIG. 13 with support shafts 45, 46 located at the middle of the third iron core 113 and the fourth iron core 114 (see also FIG. 14). The first and second iron cores 111, 112 of this embodiment are not provided with magnetic poles corresponding to the projecting magnetic pole portions 11*f*, 12*f* shown in FIGS. 1A and 1B.

The first iron core 111 has a generally square-shaped closed core portion 111*a* and a pair of projecting portions 111*f*. The closed core portion 111*a* includes left and right yoke portions 111*b* and upper and lower yoke portions 111*d* which together form a square frame structure. The two projecting portions 111*f* constituting integral parts of the upper and lower yoke portions 111*d* extend inward from the individual yoke portions 111*d* along the x-axis direction of FIG. 13. The left and right yoke portions 111*b* and the individual projecting portions 111*f* together form groovelike channels 111*e* in which the aforementioned coils 20, 30 are fitted.

The first iron core 111 is a generally square-shaped sheet metal assembly formed by stacking a specific number of ferromagnetic laminations 115, each produced by punching a thin magnetic steel sheet into a generally square window frame shape (see FIGS. 15A and 15B). The individual ferromagnetic laminations 115 are loosely bonded for ease of handling. Having the same shape as the first iron core 111, the second iron core 112 is also a generally square-shaped sheet metal assembly formed by stacking a specific number of ferromagnetic laminations 116. Like the first iron core 111, the second iron core 112 has a generally square-shaped closed core portion 112*a*, two pairs of groovelike channels 112*e* and a pair of projecting portions 112*f*. The closed core portion 112*a* includes left and right yoke portions 112*b* and upper and lower yoke portions 112*d* which together form a square frame structure (see FIG. 15A).

Referring to FIGS. 16A and 16B, the third iron core 113 has a generally U-shaped core portion 113*a* and grooves 113*k* formed in extreme end surfaces of the U-shaped core portion 113*a*. The third iron core 113 is shaped as if the first iron core 111 of FIGS. 15A and 15B is divided approximately into halves by a horizontal line. The third iron core 113 is not provided with any projecting portion in the middle of its length or any groovelike channels in which the coils 20, 30 are fitted. Both ends of the U-shaped core portion

113*a* extend like a pair of arms along the x-axis direction. The grooves 113*k* for fitting flanges 80*b* of bearings 80 are formed in the end surfaces of the "arms."

The third iron core 113 is a sheet metal assembly formed by stacking and loosely bonding a specific number of ferromagnetic laminations 117. The grooves 113*k* formed in the end surfaces of the U-shaped core portion 113*a* are cut in the x-axis direction. These grooves 113*k* are formed when the individual ferromagnetic laminations 117 are produced by punching a thin magnetic steel sheet. The fourth iron core 114 is also a sheet metal assembly formed by stacking a specific number of ferromagnetic laminations 118. Like the third iron core 113, the fourth iron core 114 has a generally U-shaped core portion 114*a* and grooves 114*k* formed in extreme end surfaces of the U-shaped core portion 114*a* (see FIGS. 16A and 16B).

The U-shaped third and fourth iron cores 113, 114 thus constructed are placed between the first iron core 111 and the second iron core 112 such that the third and fourth iron cores 113, 114 face each other along the x-axis direction shown in FIGS. 13 and 14. The U-shaped core portions 113*a*, 114*a* of the third and fourth iron cores 113, 114 together form a generally square-shaped central closed core portion. This central closed core portion and the closed core portions 111*a*, 112*a* of the first and second iron cores 111, 112 are arranged such that they overlap one another as viewed along the y-axis direction. The central closed core portion and the closed core portions 111*a*, 112*a* together form a closed iron core assembly 110*a* of the fixed iron core unit 110.

The first and second iron cores 111, 112 and the third and fourth iron cores 113, 114 together constitute the fixed iron core unit 110. A space enclosed by the closed iron core assembly 110*a* serves as an armature accommodating space 110*b*. The armature accommodating space 110*b* is parallelepiped-shaped and has open ends in both directions along the y-axis. An armature 41 is accommodated in this armature accommodating space 110*b*.

Referring to FIG. 11, the actuator of the fifth embodiment is provided with a pair of fifth iron cores 221, each formed of a square bar-shaped magnetic material. A parallelepiped-shaped permanent magnet 231 is fixed to each fifth iron core 221 by screws (not shown) at the middle of it length. The fifth iron cores 221 to which the permanent magnets 231 are fixed are fitted in a vertical position to the closed core portions 111*a*, 112*a* of the first and second iron cores 111, 112 from both sides along the y-axis direction as shown by arrows C in FIG. 11. The fifth iron cores 221 are then fixed to the closed core portions 111*a*, 112*a* by screws (not shown). The fifth iron cores 221 are situated on opposite sides of the fixed iron core unit 110 in such a manner that they face the armature 41 across specific gaps in the y-axis direction. The construction of the actuator of the fifth embodiment is otherwise identical to that of the first embodiment shown in FIGS. 1A, 1B, 2A, 2B, 3A, 3B, 4A, 4B, 4C, 5A, 5B, 6A, 6B and 7. Thus, like elements are designated by the same reference numerals and their description is omitted here.

When the coils 20, 30 are exited, there are formed first magnetic circuits which pass from a left-hand central part of the closed iron core assembly 110*a* of the fixed iron core unit 110 to a right-hand central part of the closed iron core assembly 110*a* through the armature 41 along its axial direction, as illustrated in FIG. 13. With the provision of the fifth iron cores 221 and the permanent magnets 231, there are also formed second magnetic circuits which pass, on the side of the first iron core 111, for example, from the left and right yoke portions 111*b* of the closed core portion 111*a* of the first iron core 111 through the fifth iron core 221, the permanent magnet 231 and the armature 41 and return to left and right yoke portions 111*b* of the closed core portion 111*a*.

The permanent magnets 231 serve, to hold the armature 41 at two bistable positions, that is, the first position where a left end of the armature 41 is in contact with the left yoke portion 111*b* and the second position where a right end of the armature 41 is in contact with the right yoke portion 111*b*. It is possible to produce magnetic fluxes passing through the first magnetic circuits to cancel out magnetic fluxes produced by the permanent magnets 231 and to cause the armature 41 to move back and forth between the first and second positions by properly controlling the directions of exciting currents in the same fashion as stated in the first embodiment. Although the fifth iron cores 221 and the permanent magnets 231 are provided on both sides of the fixed iron core unit 110 in this embodiment, one each fifth iron core 221 and side plate 23 may be provided on one of the first and second iron cores 111, 112 only. In addition, the embodiment may be modified such that the actuator is provided with only one of the coils 20, 30.

The aforementioned actuator of the fifth embodiment has not only the first magnetic circuits but also the second magnetic circuits produced by the closed core portions 111*a*, 112*a* of the first and second iron cores 111, 112, the fifth iron cores 221, the permanent magnets 231 and the armature 41. This makes it possible to reduce eddy currents flowing in the magnetic circuits when the coils 20, 30 are exited, leading to an improvement in the controllability of the actuator and a reduction in the capacity of a coil exciting power supply.

Sixth Embodiment

Figure 17:
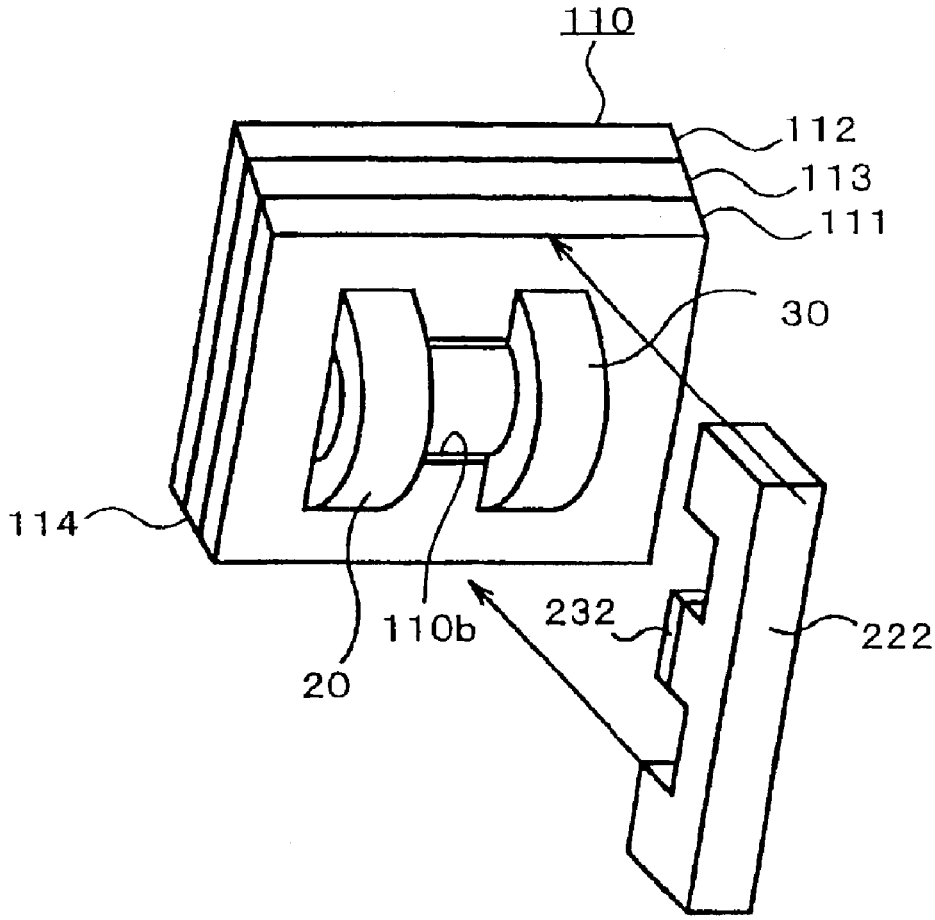
FIG. 17 is a partially exploded perspective diagram showing the construction of an actuator according to a sixth embodiment of the invention.

FIG. 17 is a partially exploded perspective diagram showing the construction of an actuator according to a sixth embodiment of the invention, in which elements identical or similar to those of the foregoing embodiments are designated by the same reference numerals.

Referring to FIG. 17, the actuator is provided with a fifth iron core 222 made of a magnetic material and having a square-shaped cross section. This fifth iron core 222 is generally E-shaped having three "arms," and a flat-plate permanent magnet 232 is fixedly bonded to the center arm of the fifth iron core 222. Like the fifth iron core 221 shown in FIG. 11, the fifth iron core 222 to which the permanent magnet 232 is affixed is fixed to the closed core portion 111*a* of the first iron core 111 on one side in such a manner that a specific gap is created between the permanent magnet 232 and the armature 41 which is not illustrated.

Seventh Embodiment

Figure 18:
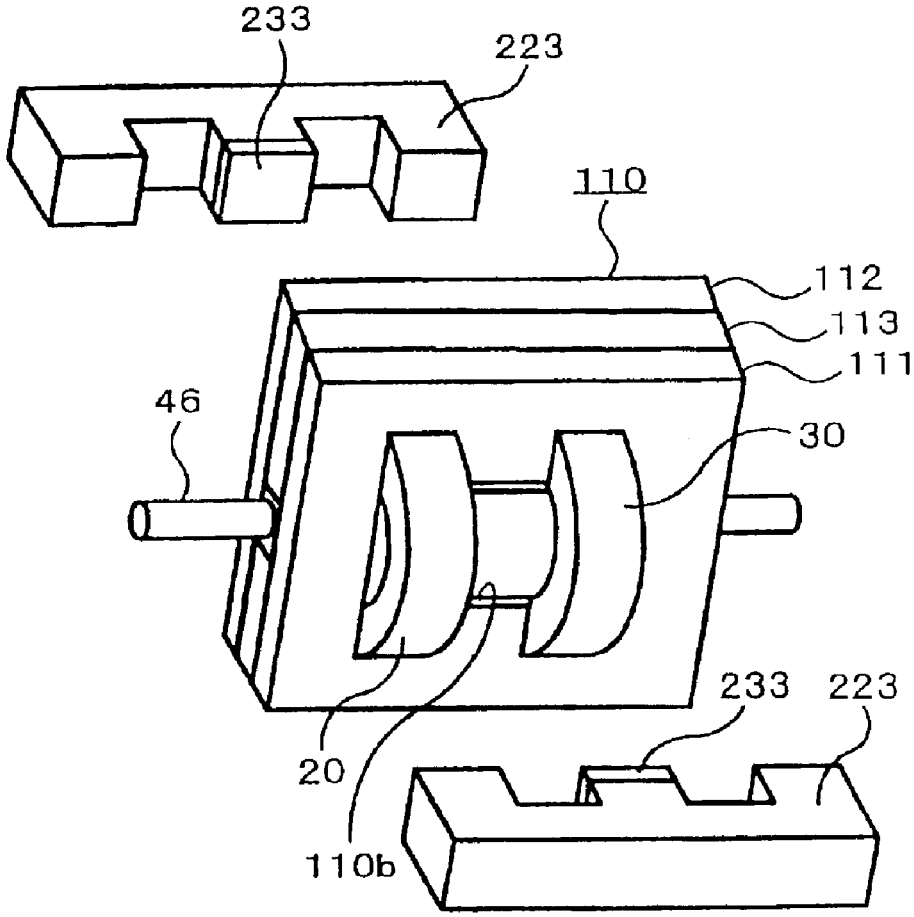
FIG. 18 is a partially exploded perspective diagram showing the construction of an actuator according to a seventh embodiment of the invention.
Figure 19:
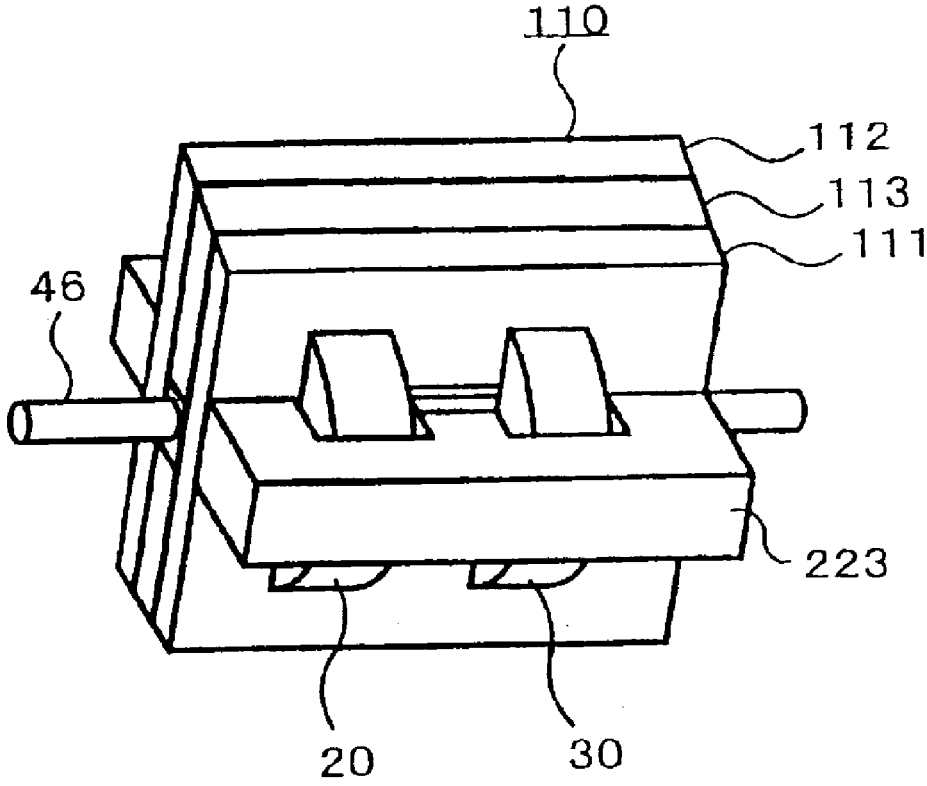
FIG. 19 is a perspective assembly diagram of the actuator of FIG. 18.
Figure 20A:
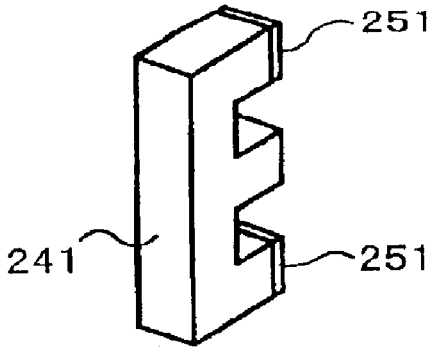
FIGS. 20A, 20B, 20C, 20D, 20E and 20F are perspective diagrams showing combinations of fifth iron cores and permanent magnets according to an eighth embodiment of the invention.
Figure 20B:
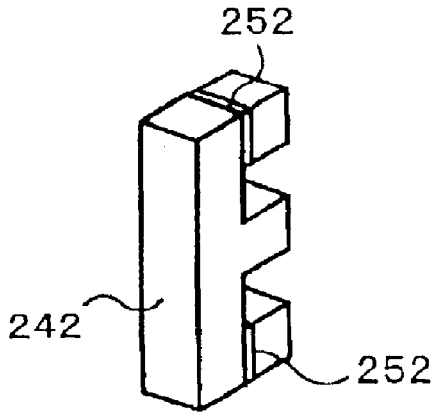
Figure 20C:
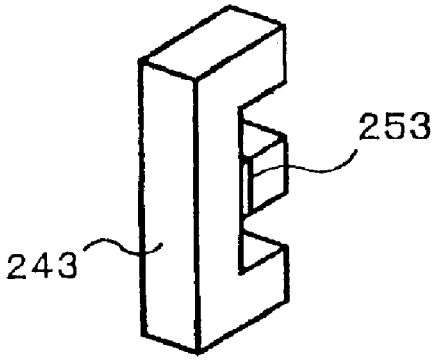
Figure 20D:
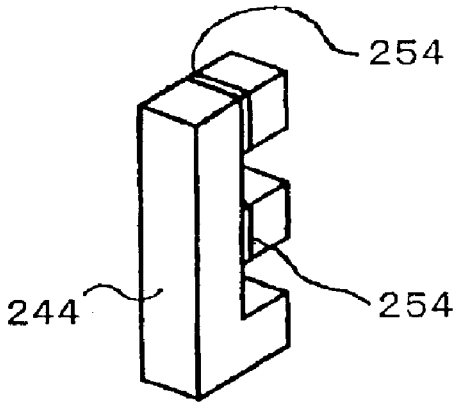
Figure 20E:
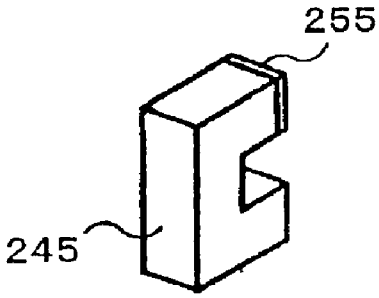
Figure 20F:
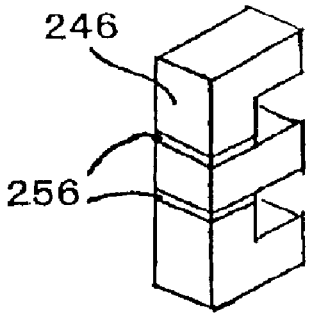

FIG. 18 is a partially exploded perspective diagram and FIG. 19 is a perspective assembly diagram showing the construction of an actuator according to a seventh embodiment of the invention, in which elements identical or similar to those of the foregoing embodiments are designated by the same reference numerals.

Referring to FIG. 18, the actuator is provided with a pair of fifth iron cores 223 made of a magnetic material and having a square-shaped cross section. Each fifth iron core 223 is generally E-shaped having three "arms," and a flat-plate permanent magnet 233 is fixed to the center arm of the fifth iron core 223 by a screw which is not illustrated. The two fifth iron cores 223 to which the permanent magnets 233 are affixed are fixed to the closed core portions 111*a*, 112*a* of the first and second iron cores 111, 112 from both sides in such a manner that the fifth iron cores 223 are oriented parallel to the moving direction (axial direction) of the unillustrated armature 41 as shown in FIG. 18 and specific gaps are created between the armature 41 and the permanent magnets 233.

Eighth Embodiment

FIGS. 20A, 20B, 20C, 20D, 20E and 20F are perspective diagrams showing combinations of fifth iron cores 241–246 and permanent magnets 251–256 according to an eighth embodiment of the invention. The combinations of the fifth iron cores 241–246 and the permanent magnets 251–256 shown in these Figures can be used instead of the fifth iron cores and the permanent magnets of the fifth to seventh embodiments shown in FIGS. 11, 17 and 18. While the fifth iron cores of the fifth to seventh embodiments bridge the left and right yoke portions 111*b*, 112*b* or the upper and lower yoke portions 111*d*, 112*d*, the combination of the fifth iron core 245 and the permanent magnet 255 shown in FIG. 20E may magnetically bridge the armature 41 and one of the left and right yoke portions 111*b*, 112*b* or the upper and lower yoke-portions 111*d*, 112*d*.

Ninth Embodiment

Figure 21B:
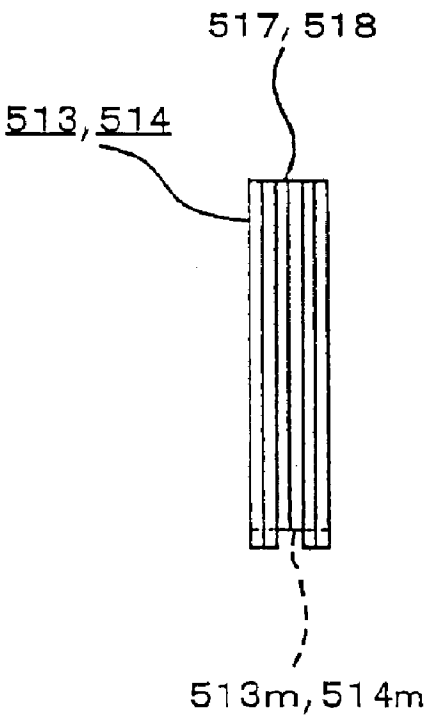
FIGS. 21A and 21B are a front view and a side view of third and fourth iron cores of an actuator according to a ninth embodiment of the invention.
Figure 21A:
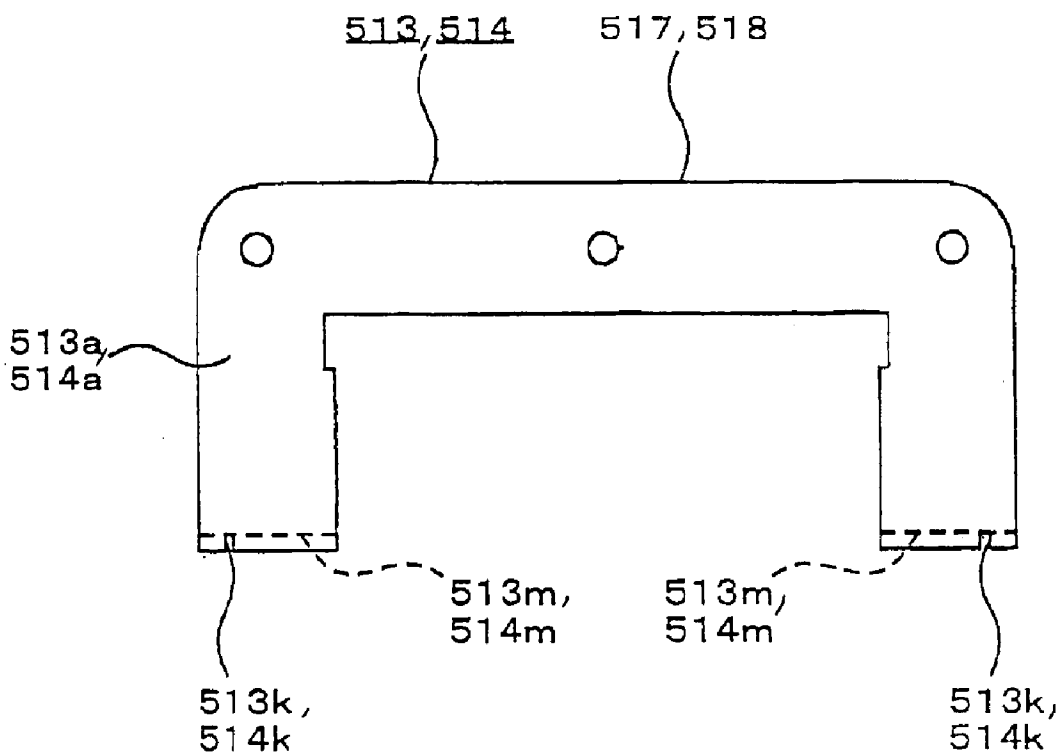
Figure 22A:
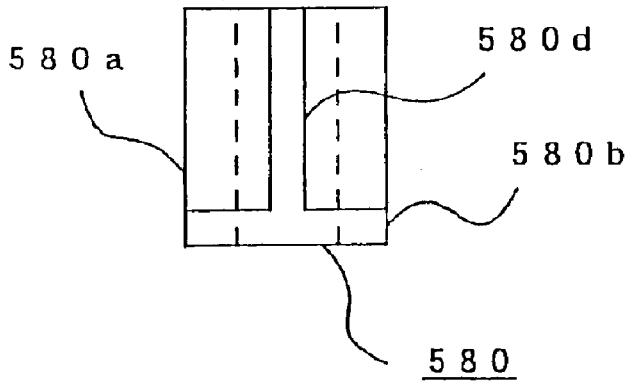
FIGS. 22A, 22B and 22C are a plan view, a front view and a side view of bearings used in the actuator of the ninth embodiment.
Figure 22B:
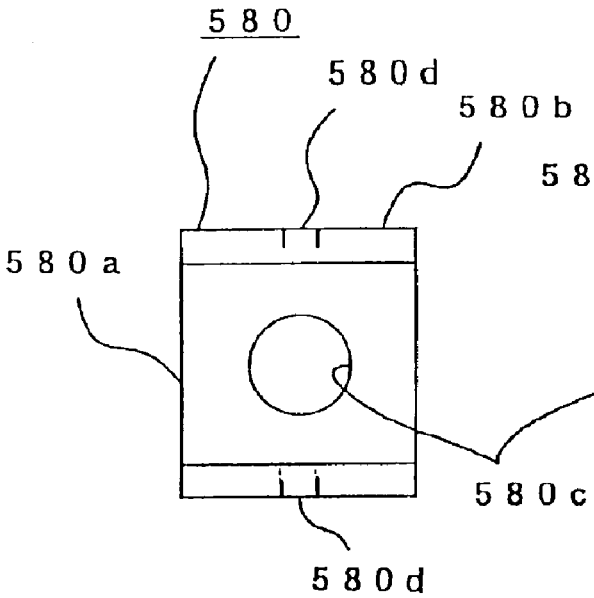
Figure 22C:
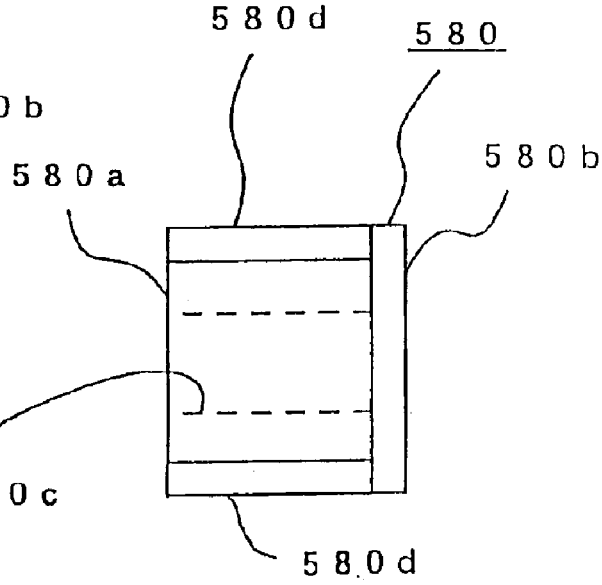
Figure 23:
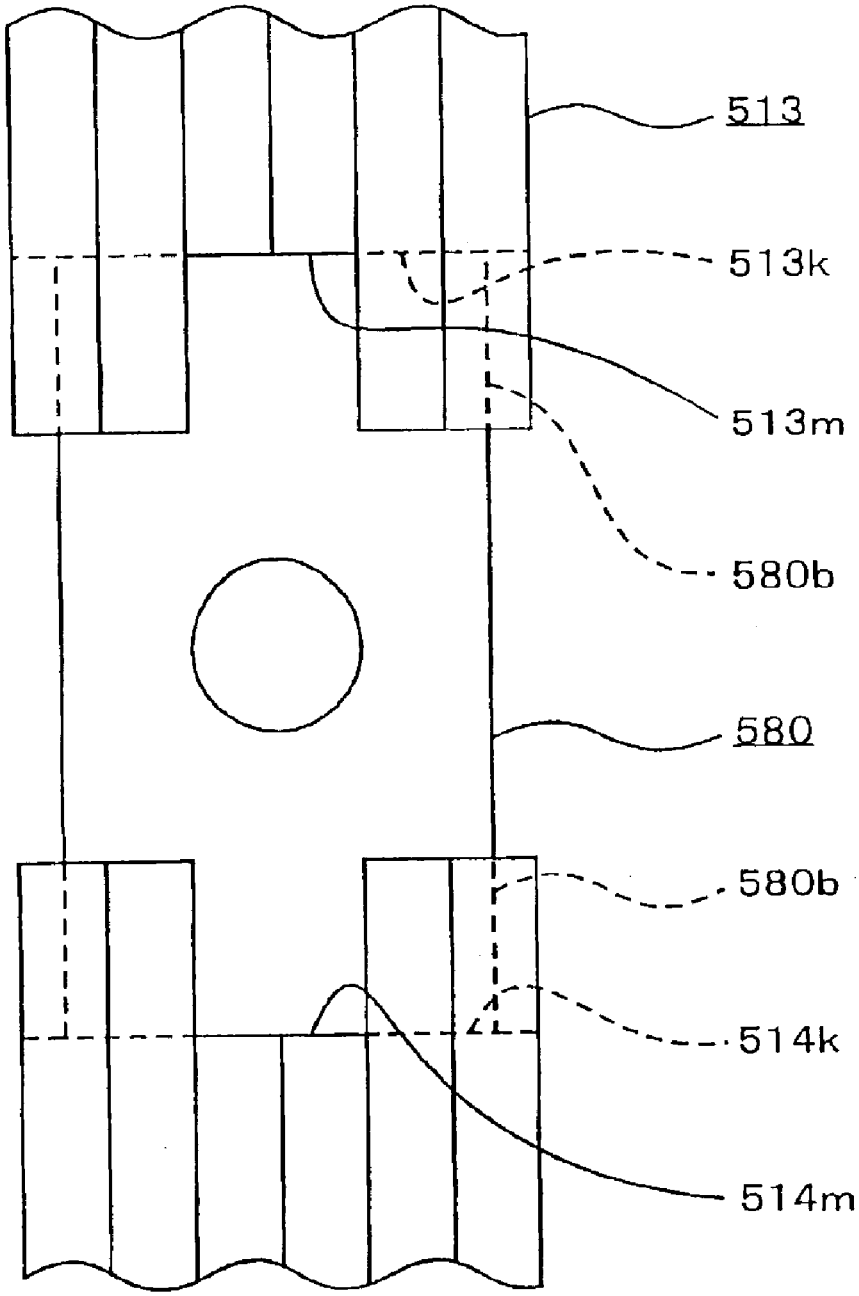
FIG. 23 is a fragmentary side view of the third and fourth iron cores fitted with the bearings of the ninth embodiment.

FIGS. 21A, 21B, 22A, 22B and 22C and 23 show principal elements of an actuator according to a ninth embodiment of the invention, in which FIGS. 21A and 21B are a front view and a side view of third and fourth iron cores 513, 514, FIGS. 22A, 22B and 22C are a plan view, a front view and a side view of bearings 580, and FIG. 23 is a fragmentary side view of the third and fourth iron cores 513, 514 fitted with the bearing 580.

As depicted in FIGS. 21A and 21B, the third iron core 513 has a U-shaped core portion 513*a*, grooves 513*k* and second grooves 513*m*. Having the same structure as the grooves 113*k* of FIGS. 16A and 16B, the grooves 513*k* extend in the direction perpendicular to the plane of paper of FIGS. 21A and 21B with a specific width. Formed in extreme end surfaces of the U-shaped core portion 513*a* of the third iron core 513, the second grooves 513*m* pass through both ends of the third iron core 513 in the left-right directions as illustrated in FIG. 21A with a specific width at about the middle of the stacking thickness of ferromagnetic laminations 517. The groove 513*k* and the second groove 513*m* intersect each other at right angles.

Similarly, the fourth iron core 514 has a U-shaped core portion 514*a*, grooves 514*k* and second grooves 514*m*. Having the same structure as the grooves 114*k* of FIGS. 16A and 16B, the grooves 514*k* extend in the direction perpendicular to the plane of paper of FIGS. 21A and 21B with a specific width. Formed in extreme end surfaces of the U-shaped core portion 514*a* of the fourth iron core 514, the second grooves 514*m* pass through both ends of the fourth iron core 514 in the left-right directions as illustrated in FIG. 21A with a specific width at about the middle of the stacking thickness of ferromagnetic laminations 518. The groove 514*k* and the second groove 514*m* intersect each other at right angles.

Referring to FIGS. 22A, 22B and 22C, the bearings 580 each have a parallelepiped-shaped portion (main portion) 580*a*, upper and lower flanges 580*b*, a through hole 580*c* and a pair of upper and lower projections 580*d*. The flanges 580*b* are flat-shaped projecting portions extending upward and downward from one end of the parallelepiped-shaped portion 580*a* as illustrated in FIGS. 22A, 22B and 22C. The width of the parallelepiped-shaped portion 580*a* (as measured in the left-right directions of FIG. 23) is made slightly smaller than the stacking thickness of the ferromagnetic laminations 517, 518 of the third and fourth iron cores 513, 514. The projections 580*d* are flat-shaped projecting portions extending upward and downward to the same height as the flanges 580*b* as illustrated in FIG. 22C. The flange 580*b* and the projection 580*d* together form a generally T-shaped projection as viewed from top (FIG. 22A). Unless otherwise mentioned heretofore, the actuator of the eighth embodiment has substantially the same construction as the actuator of the fifth embodiment shown in FIGS. 13 and 14.

The third and fourth iron cores 513, 514 thus constructed sandwich the parallelepiped-shaped portions 580*a* of the bearings 580 from top and bottom as illustrated in FIG. 23. More specifically, the flanges 580*b* of the bearings 580 fit into the grooves 513*k*, 514*k* of the third and fourth iron cores 513, 514 and the projections 580*d* of the bearings 580 fit into the second grooves 513*m*, 514*m* of the third and fourth iron cores 513, 514 to keep the bearings 580 from being displaced along the y- and z-axis directions. Small gaps are left between the grooves 513*k*, 514*k* and the flanges 580*b* of the bearings 580 and between the second grooves 513*m*, 514*m* and the projections 580*d* of the bearings 580 in the x-axis direction (the vertical direction as illustrated in FIG. 23), so that the main portions 580*a* of the bearings 580 are tightly held between the end surfaces of the third iron core 513 and the fourth iron core 514.

The width of each bearing 580 (as measured in the y-axis direction) is made slightly smaller than the stacking thickness of the ferromagnetic laminations 517, 518 of the third and fourth iron cores 513, 514 as shown in FIG. 23. Therefore, when the third and fourth iron cores 513, 514 are sandwiched between the first and second iron cores 111, 112 (not shown in FIG. 23, refer to FIGS. 13 and 14) from the left and right directions as illustrated in FIG. 23, the bearings 580 are held at fixed positions by the third and fourth iron cores 513, 514, and not by the first and second iron cores 111, 112, leaving gaps between the bearings 580 and the first and second iron cores 111, 112.

In the ninth embodiment described above, the third and fourth iron cores 513, 514 have the second grooves 513*m*, 514*m* in which the projections 580*d* of the bearings 580 are fitted. In this construction, the bearings 580 can be easily kept from being displaced along the left-right directions of FIG. 23, or in the y-axis direction of FIG. 13, by the third and fourth iron cores 513, 514, and not by the first and second iron cores 111, 112.

Tenth Embodiment

Figure 24B:
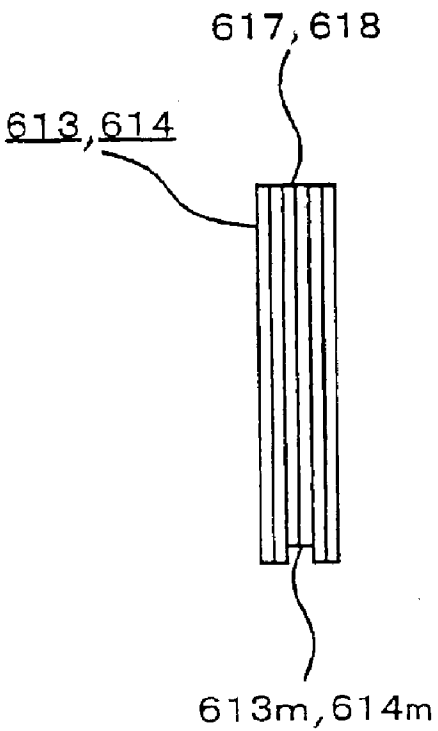
FIGS. 24A and 24B are a front view and a side view of third and fourth iron cores of an actuator according to a tenth embodiment of the invention.
Figure 24A:
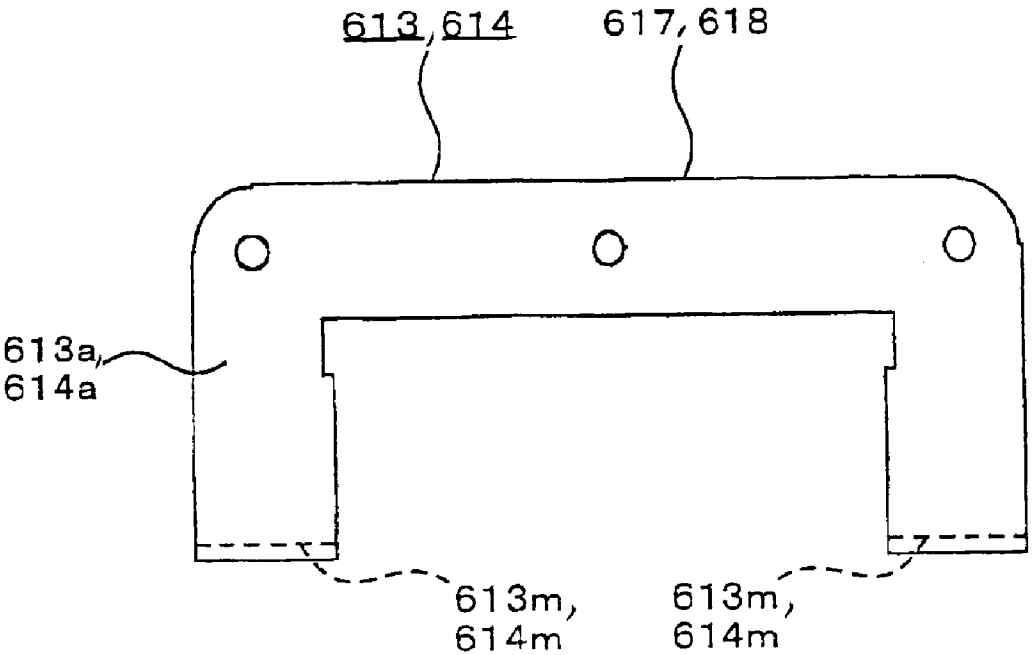
Figure 25A:
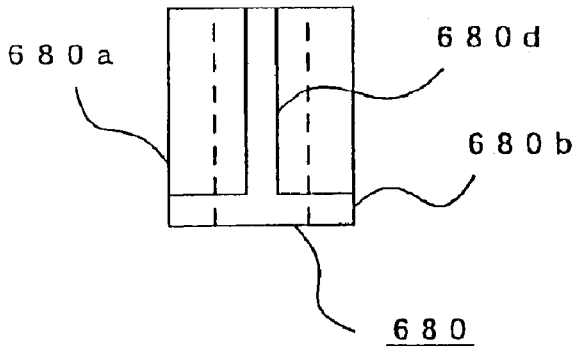
FIGS. 25A, 25B and 25C are a plan view, a front view and a side view of bearings used in the actuator of the tenth embodiment.
Figure 25B:
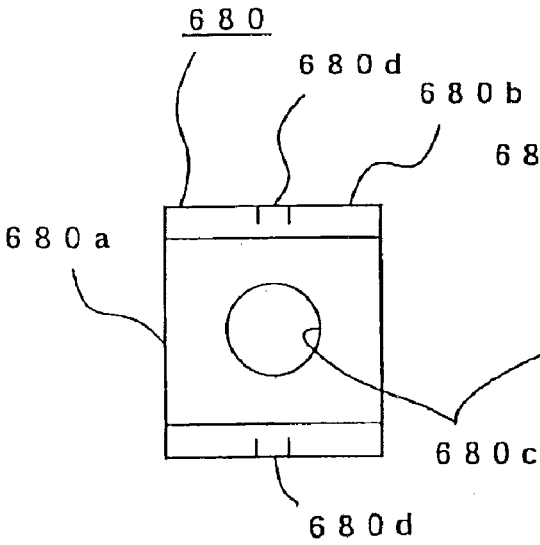
Figure 25C:
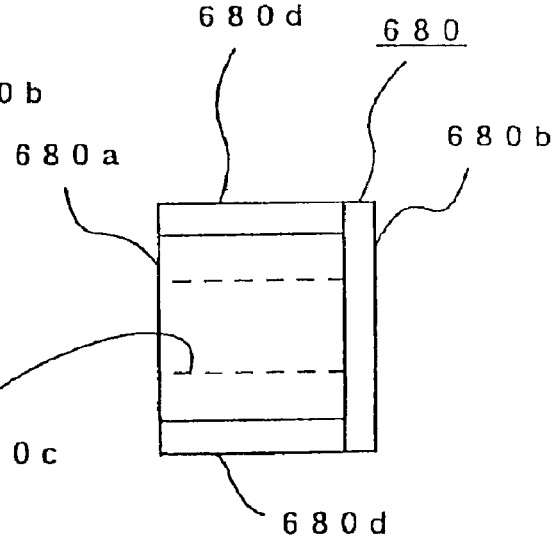
Figure 26:
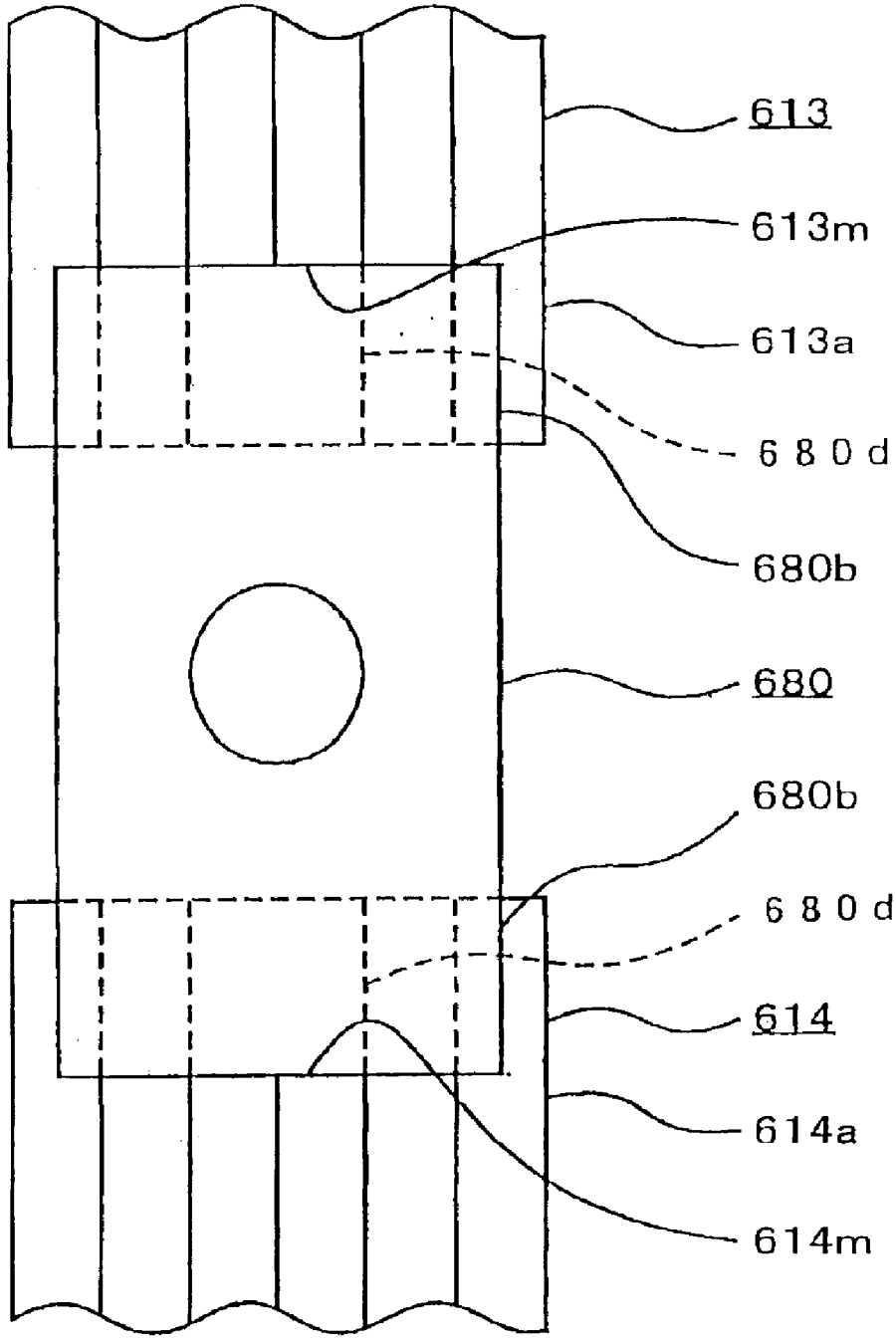
FIG. 26 is a fragmentary side view of the third and fourth iron cores fitted with the bearings of the tenth embodiment.

FIGS. 24A, 24B, 25A, 25B and 25C and 26 show principal elements of an actuator according to a tenth embodiment of the invention, in which FIGS. 24A and 24B are a front view and a side view of third and fourth iron cores 613, 614, FIGS. 25A, 25B and 25C are a plan view, a front view and a side view of bearings 680, and FIG. 26 is a fragmentary side view of the third and fourth iron cores 613, 614 fitted with the bearing 680.

As depicted in FIGS. 24A and 24B, the third iron core 613 has a U-shaped core portion 613*a* and second grooves 613*m*. The second grooves 613*m* have the same structure as the second grooves 513*m* of FIGS. 21A and 21B. Formed in extreme end surfaces of the U-shaped core portion 613*a* of the third iron core 613, the second grooves 613*m* pass through both ends of the third iron core 613 in the left-right directions as illustrated in FIG. 24A with a specific width at about the middle of the stacking thickness of ferromagnetic laminations 617.

Similarly, the fourth iron core 614 has a U-shaped core portion 614*a* and second grooves 614*m*. The second grooves 614*m* have the same structure as the second grooves 514*m* of FIGS. 21A and 21B. Formed in extreme end surfaces of the U-shaped core portion 614*a* of the fourth iron core 614, the second grooves 614*m* pass through both ends of the fourth iron core 614 in the left-right directions as illustrated in FIG. 24A with a specific width at about the middle of the stacking thickness of ferromagnetic laminations 618.

Referring to FIGS. 25A, 25B and 25C, the bearings 680 each have a parallelepiped-shaped portion (main portion) 680*a*, upper and lower flanges 680*b*, a through hole 680*c* and a pair of upper and lower projections 680*d*. The flanges 680*b* are flat-shaped projecting portions extending upward and downward from one end of the parallelepiped-shaped portion 680*a* as illustrated in FIGS. 25A, 25B and 25C. The width of the parallelepiped-shaped portion 680*a* (as measured in the left-right directions of FIG. 26) is made slightly smaller than the stacking thickness of the ferromagnetic laminations 617, 618 of the third and fourth iron cores 613, 614. The projections 680*d* are flat-shaped projecting portions extending upward and downward to the same height as the flanges 680*b* as illustrated in FIG. 25C. The flange 680*b* and the projection 680*d* together form a generally T-shaped projection as viewed from top (FIG. 25A). Unless otherwise mentioned heretofore, the actuator of the tenth embodiment has substantially the same construction as the actuator of the fifth embodiment shown in FIGS. 13 and 14.

The third and fourth iron cores 613, 614 thus constructed sandwich the parallelepiped-shaped portions 680*a* of the bearings 680 from top and bottom as illustrated in FIG. 26. More specifically, the projections 680*d* of the bearings 680 fit into the second grooves 613*m*, 614*m* of the third and fourth iron cores 613, 614 to keep the bearings 680 from being displaced along the y-axis direction of the bearings 680 (the left-right directions as illustrated in FIG. 26). The bearings 680 are set to fixed positions in the z-axis direction as their flanges 680*b* are kept in contact with the third and fourth iron cores 613, 614. The bearings 680 are bonded to the third and fourth iron cores 613, 614 or screwed thereto to keep the bearings 680 from being displaced along the z-axis direction of the bearings 680. Small gaps are left between the second grooves 613*m*, 614*m* and the projections 680*d* of the bearings 680 in the x-axis direction (the vertical direction as illustrated in FIG. 26), so that the main portions 680*a* of the bearings 680 are tightly held between the end surfaces of the third iron core 613 and the fourth iron core 614.

The width of each bearing 680 (as measured in the y-axis direction) is made slightly smaller than the stacking thickness of the ferromagnetic laminations 617, 618 of the third and fourth iron cores 613, 614 as shown in FIG. 26. Therefore, when the third and fourth iron cores 613, 614 are sandwiched between the first and second iron cores 111, 112 (not shown in FIG. 26, refer to FIGS. 13 and 14) from the left and right directions as illustrated in FIG. 26, the bearings 680 are held at fixed positions by the third and fourth iron cores 613, 614, and not by the first and second iron cores 111, 112, leaving gaps between the bearings 680 and the first and second iron cores 111, 112.

In the tenth embodiment described above, the third and fourth iron cores 613, 614 have the second grooves 613*m*, 614*m* in which the projections 680*d* of the bearings 680 are fitted. In this construction, the bearings 680 can be easily kept from being displaced along the left-right directions of FIG. 26, or in the y-axis direction of FIG. 13, by the third and fourth iron cores 613, 614, and not by the first and second iron cores 111, 112.

Eleventh Embodiment

The actuators of the foregoing embodiments are provided with coils and permanent magnets, wherein the armature is held at the first or second positions by the permanent magnets and caused to move from the first position to the second position, and vice versa, by exciting the coils.

In a linear pump, a resonance actuator and a vibrator, for example, an actuator simply moves back and forth between two positions and are not held stationary at either of these positions, so that there is no need to provide permanent magnets.

In a case where the actuator is used in a circuit breaker as in the foregoing embodiments, it is necessary to hold the actuator at a pair of bistable positions. While the foregoing embodiments employ the permanent magnets to hold the actuator at the bistable positions, it is possible to hold the actuator by flowing currents through exciting coils without the need for the permanent magnets.

Described hereunder is an actuator according to an eleventh embodiment which is not provided with any permanent magnets.

Figure 27B:
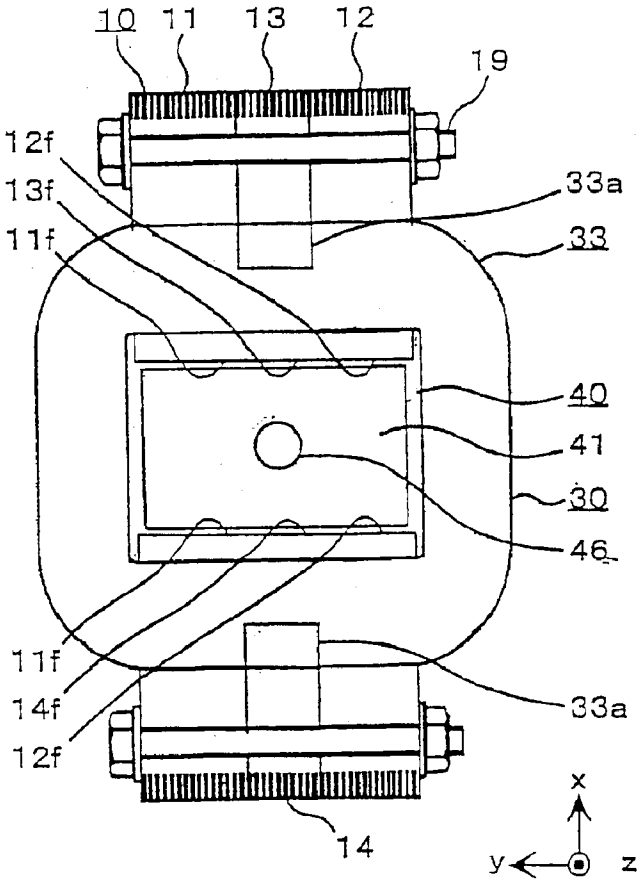
FIGS. 27A and 27B are sectional diagrams showing the construction of an actuator according to an eleventh embodiment of the invention.
Figure 27A:
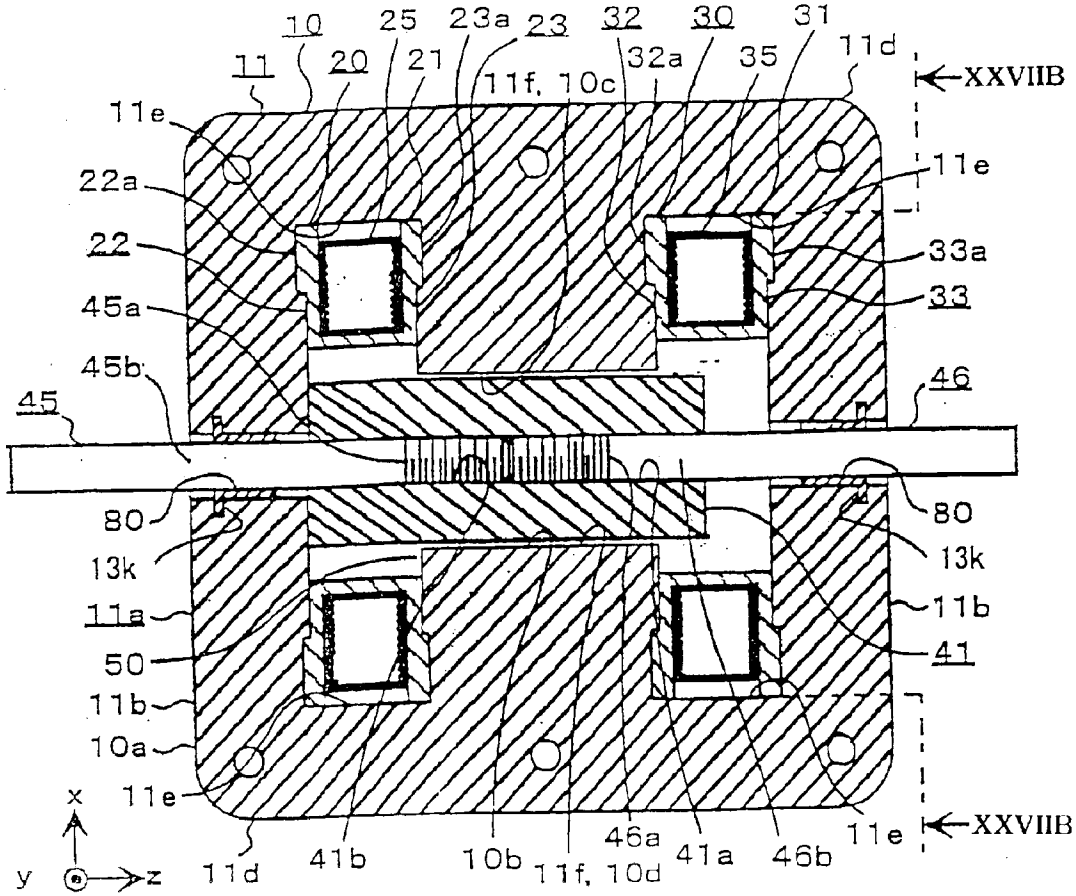

FIG. 27A is a sectional diagram showing the construction of the actuator of the eleventh embodiment, and FIG. 27B is a sectional diagram taken along lines XXVIIB—XXVIIB of FIG. 27A, in which elements identical or similar to those of the foregoing embodiments are designated by the same reference numerals.

Compared to the construction of the first embodiment shown in FIGS. 1A and 1B, the actuator of the eleventh embodiment is not provided with any permanent magnets 50. In the actuator of this embodiment, opposing magnetic poles 10*c*, 10*d* formed by projecting magnetic pole portions 11*f*, 12*f* of first and second iron cores 11, 12 and projecting magnetic pole portions 13*f*, 14*f* of third and fourth iron cores 13, 14 extend toward an armature 41 as if occupying the spaces of the permanent magnets 50 of the first embodiment.

In this construction, the opposing magnetic poles 10*c*, 10*d* directly face the armature 41 across narrow gaps created in between. Surfaces of the armature 41 facing the opposing magnetic poles 10*c*, 10*d* are made smooth by plating, for instance, so that no serious problems occur even when the armature 41 slides along the opposing magnetic poles 10*c*, 10*d* or along inside portions of the bobbins 21, 31 of the coils 20, 30.

The working of the actuator of this embodiment is now described hereunder referring again to FIG. 7.

When exited, the coil 20 produces magnetic fluxes passing through magnetic circuits as shown by black arrows A in FIG. 7. Consequently, the armature 41 moves leftward as illustrated in FIG. 7 and is held in contact with a left-hand inside surface of a closed iron core assembly 10*a* which is formed of closed core portions 11*a*, 12*a* of the first and second iron cores 11, 12 and U-shaped core portions 13*a*, 14*a* of the third and fourth iron cores 13, 14.

If an exciting current flowing through the coil 20 is interrupted and the coil 30 is excited, the coil 30 produces magnetic fluxes passing through magnetic circuits as shown by outline arrows B in FIG. 7. These magnetic fluxes produce an attractive force exerted between the armature 41 and a right-hand inside surface of the closed iron core assembly 10*a*. This attractive force causes the armature 41 to move rightward by a specific distance so that the armature 41 goes into contact with the right-hand inside surface of the closed iron core assembly 10*a*. If an exciting current flowing through the coil 30 is maintained, the armature 41 is held in contact with the right-hand inside surface of the closed iron core assembly 10*a* at the same position.

If the current flowing through the coil 30 is interrupted and the coil 20 is exited next, the armature 41 moves leftward according to the same principle of operation as explained above and returns to the left-hand position shown in FIG. 7. A switching device, such as a vacuum switch, of a power supply circuit breaker connected to the support shaft (rod member) 45 or 46 of the armature 41 is driven in the aforementioned manner.

The actuator of this embodiment, if used as a prime mover of a vibrator, for instance, does not provide any force for retaining the armature 41 at both ends of the stroke of the armature 41 and, therefore, the actuator is used for moving the armature 41 only.

While the actuator of the eleventh embodiment unprovided with any permanent magnets has been described as a variation of the actuator of the first embodiment, the arrangement of the eleventh embodiment is also applicable to the other foregoing embodiments.

While the first to fourth iron cores 111–114 and the fifth iron cores 221 are formed by laminating magnetic steel sheets in the foregoing embodiments, these iron cores may be formed as solid blocks of magnetic material to obtain the same advantageous effects as so far described. Also, although the armatures 41–43 of the foregoing embodiments are parallelepiped-shaped blocks of magnetic steel, they may be formed by laminating magnetic steel sheets. Furthermore, the permanent magnets SO and the support plates 60 of the first embodiment of FIGS. 1A and 1B, for example, may be together fixed by screws or adhesive bonding to the armature 41. In this alternative, the support plates need not be L-shaped in side view but may be formed into a simple flat shape. Moreover, the actuators of the fifth to seventh embodiments may be provided with support plates for covering surfaces of the permanent magnets 231, 232, 233 such that no problem would occur when the armature 41 slides along the permanent magnets 231, 232, 233.

While the first to fourth iron cores of the foregoing embodiments have a generally rectangular outline shape as viewed along the y-axis direction of FIG. 1A, changes may be made in the shape of the iron cores without departing from the earlier-mentioned object of the invention. Furthermore, the fifth iron cores need not necessarily be straight or E-shaped but may be modified to other shapes.

Moreover, although the invention has thus far been described with reference to the actuators for opening and closing contacts of a power supply circuit breaker, the actuators of the invention can be used in various applications, such as for opening and closing valves in a liquid or gas transport line or for opening and closing doors.

What is claimed is:

1. An actuator comprising:

a fixed iron core unit including first, second, third, and fourth iron cores, the first iron core having a closed core portion and groovelike channels between the closed core portion, and a pair of projecting portions extending inward from opposite sides of the closed core portion along an x-axis direction of a Cartesian coordinate system defined by x-, y- and z-axes of the closed core portion, the second iron core having a closed core portion, and the third and fourth iron cores individually having split core portions, in which the closed core portions of the first and second iron cores are placed, face-to-face, at a fixed distance from each other along a y-axis direction of the Cartesian coordinate system so that the first and second iron cores overlap each other as viewed along the y-axis direction, the third and fourth iron cores are placed face-to-face with each other, along the x-axis direction, between the first and second iron cores so that the split core portions of the third and fourth iron cores together constitute a central closed core portion which overlaps the closed core portions of the first and second iron cores as viewed along the y-axis direction, and the closed core portions of the first and second iron cores and the central closed core portion formed by the split core portions of the third and fourth iron cores together form and surround an armature accommodating space;

an armature unit including an armature made of a magnetic material and first and second rod members attached to the armature; and a coil including a bobbin and a winding wound around the bobbin, the bobbin having projections extending along a z-axis direction of the Cartesian coordinate system, wherein the coil is fitted in the groove like channels in the first iron core, preventing the coil from being displaced along the x- and z-axis directions, the projections of the bobbin are sandwiched between the first and second iron cores, from opposite sides along the y-axis direction, preventing the coil from being displaced along the y-axis, and the armature of the armature unit is accommodated in the armature accommodating space and supported movably along the z-axis direction by the first and second rod members which are fitted in bearings in the fixed iron core unit.

2. An actuator comprising:

a fixed iron core unit including first, second, third, and fourth iron cores, the first and second iron cores individually having closed core portions, and the third and fourth iron cores individually having split core portions, the third and fourth iron cores being placed face-to-face with each other along an x-axis direction of a Cartesian coordinate system defined by x-, y- and z-axes of the closed core portions, between the first and second iron cores so that the split core portions of the third and fourth iron cores together constitute a central closed core portion which overlaps the closed core portions of the first and second iron cores, as viewed along an y-axis direction of the Cartesian coordinate system, and the closed core portions of the first and second iron cores and the central closed core portion formed by the split core portions of the third and fourth iron cores together form and surround an armature accommodating space;

an armature unit including an armature made of a magnetic material and first and second rod members attached to the armature; and bearings sandwiched between the split core portions of the third and fourth iron cores from opposite sides along the x-axis direction and held between the third and fourth iron cores, wherein the armature of the armature unit is accommodated in the armature accommodating space and supported movably along a z-axis direction of the Cartesian coordinate system by the first and second rod members, which are fitted in the bearings, and the armature is moved from a first position to a second position, and, vice versa, along the z-axis direction in response to excitation of a coil.

3. The actuator according to claim 2, including grooves in the x-axis direction in facing end surfaces of the third and fourth iron cores, wherein the bearings individually have main portions and projecting portions extending along the x-axis direction from the main portions, the main portions of the bearings are sandwiched between the third and fourth iron cores from opposite sides along the x-axis direction and held therebetween, and the projecting portions of the bearings are fitted in the grooves, whereby the bearings are kept from moving along at least one of the y- and z-axis directions.

4. The actuator according to claim 3, wherein the grooves extend along at least along one of the y- and z-axis directions, and the projecting portions of the bearings are fitted in the grooves, whereby the bearings are kept from moving at least along one of the y- and z-axis directions.

5. The actuator according to claim 2, wherein the third and fourth iron cores include laminated magnetic steel sheets.

6. The actuator according to claim 1 further comprising permanent magnets wherein the projecting portions of the first iron core constitute a pair of projecting magnetic poles extending face-to-face along the x-axis direction from the opposite sides of the closed core portion of the first iron core, leaving a gap in between, along the x-axis direction, the second iron core has a pair of projecting magnetic poles extending face-to-face along the x-axis direction from opposite sides of the closed core portion of the second iron core, leaving a gap in between, along the x-axis direction, the third and fourth iron cores individually have projecting magnetic poles extending along the x-axis direction from inside surfaces of the split core portions, the projecting magnetic poles of the first and second iron cores on a first side and the projecting magnetic pole of the third iron core together constitute an opposing magnetic pole, and the projecting magnetic poles of the first and second iron cores on the a second side and the projecting magnetic pole of the fourth iron core together constitute another opposing magnetic pole; and the permanent magnets are located between the opposing magnetic poles and the armature and affixed to the opposing magnetic poles or the armature, and the armature is held at a first position and a second position along the z-axis direction by magnetic forces produced by the permanent magnets and moved from the first position to the second position, and, vice versa, along the z-axis direction in response to excitation of the coil.

7. The actuator according to claim 6, wherein the permanent magnets are embedded in recesses in the armature and affixed thereto so that the permanent magnets are flush with surfaces of the armature.

8. The actuator according to claim 6 further comprising support plates fixed to the armature or the opposing magnetic poles, each of the support plates covering a surface of each permanent magnet, whereby the support plates can slide along the armature or the opposing magnetic poles.

9. The actuator according to claim 8, wherein both ends of each of the support plates are oppositely extended along the z-axis direction, forming extended portions which are curved so that the extended portions grip each of the permanent magnets.

10. The actuator according to claim 6, wherein the bearings are sandwiched between the split core portions of the third and fourth iron cores, from opposite sides, along the x-axis direction and held therebetween.

11. The actuator according to claim 10, wherein grooves in the x-axis direction are in facing end surfaces of the third and fourth iron cores, the bearings individually have main portions and projecting portions, the main portions of the bearings are sandwiched between the third and fourth iron cores from opposite sides along the x-axis direction and held therebetween, and the projecting portions of the bearings are fitted in the grooves, whereby the bearings are kept from moving along the z-axis direction.

12. The actuator according to claim 10, wherein the armature accommodating space permits the permanent magnets to be inserted between the opposing magnetic poles and the armature along the y-axis direction.

13. The actuator according to claim 1, wherein said fixed iron core unit includes a fifth iron core and a permanent magnet, the fifth iron core being outside of at least one of the closed core portions of the first and second iron cores, with an end of the fifth iron core disposed face-to-face with the armature along the y-axis direction, the fifth iron core constituting part of a magnetic circuit through which a magnetic flux passes from the one of the closed core portions through the armature along a moving direction of the armature and returns to the one of the closed core portions, the permanent magnet being provided in the magnetic circuit, and the armature is held at a first position and a second position along the z-axis direction by a magnetic force produced by the permanent magnet and moved from the first position to the second position, and, vice versa, along the z-axis direction in response to excitation of the coil.

14. The actuator according to claim 1, wherein the armature has a through hole through itself along the z-axis direction and an internally threaded portion located approximately centrally of the through hole, and the first and second rod members each have a shank portion having a smooth surface and an externally threaded portion engaging the internally threaded portion of the through hole in the armature, whereby one end of the first rod member and one end of the second rod member are held in contact with each other.

15. The actuator according to claim 14, wherein the shank portions of the first and second rod members are in direct contact with an inside surface of the through hole in the armature and supported thereby.

16. The actuator according to claim 14, wherein the first and second rod members are made of a nonmagnetic material.

17. The actuator according to claim 1, wherein at least one of the armature and the first, second, third, and fourth iron cores includes laminated magnetic steel sheets.

* * * * *